US006212737B1

(12) United States Patent
Faas

(10) Patent No.: US 6,212,737 B1
(45) **Date of Patent: *Apr. 10, 2001**

(54) PLANT FOR PROCESSING FIBERS

(75) Inventor: Jürg Faas, Andelfingen (CH)

(73) Assignee: Maschinenfabrik Rieter AG, Winterthur (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/856,866

(22) Filed: May 15, 1997

(30) Foreign Application Priority Data

May 20, 1996 (CH) ..... 1264/96
Jul. 25, 1996 (DE) ..... 196 30 018

(51) Int. Cl.[7] ..... D01G 15/00

(52) U.S. Cl. ..... 19/98; 19/65 A; 19/80 R; 19/200

(58) Field of Search ..... 19/65 A, 80 R, 19/97.5, 98, 99, 104, 105, 112, 113, 145.5, 145.7, 200, 204, 205

(56) References Cited

U.S. PATENT DOCUMENTS

| | | | |
|---|---|---|---|
| 3,470,588 | 10/1969 | Just . | |
| 4,345,356 | 8/1982 | Handschuch et al. . | |
| 4,507,827 | 4/1985 | Staehli . | |
| 4,512,060 | 4/1985 | Shofner . | |
| 4,527,306 * | 7/1985 | Thannheiser | 19/105 |
| 4,535,511 | 8/1985 | Leifeld et al. . | |
| 4,731,909 | 3/1988 | Duda . | |
| 4,779,310 | 10/1988 | Leifeld . | |
| 4,876,769 | 10/1989 | Schlepfer et al. . | |
| 4,890,357 | 1/1990 | Pinto et al. . | |
| 4,928,355 | 5/1990 | Leifeld . | |
| 4,939,815 | 7/1990 | Leifeld . | |
| 4,940,367 | 7/1990 | Stäheli et al. . | |

(List continued on next page.)

FOREIGN PATENT DOCUMENTS

| | | |
|---|---|---|
| 231054 | 5/1963 | (DE) . |
| 3151063A1 | 7/1983 | (DE) . |
| 4038686A1 | 6/1991 | (DE) . |
| 4038838A1 | 7/1991 | (DE) . |
| 0110017B1 | 6/1984 | (EP) . |
| 0221306 | 5/1987 | (EP) . |
| 0361276 | 4/1990 | (EP) . |
| 0399315 | 11/1990 | (EP) . |
| 0481302A2 | 4/1992 | (EP) . |
| 0497535A1 | 8/1992 | (EP) . |
| 0641870 | 3/1995 | (EP) . |
| 0641876 | 3/1995 | (EP) . |
| 2599053 | 11/1987 | (FR) . |
| 1545928 | 5/1979 | (GB) . |
| 2132382 | 7/1984 | (GB) . |
| 2210908 | 6/1989 | (GB) . |
| 2271126 | 4/1994 | (GB) . |
| 2289693 | 11/1995 | (GB) . |

*Primary Examiner*—Michael A. Neas
*Assistant Examiner*—Gary L. Welch
(74) *Attorney, Agent, or Firm*—Dority & Manning

(57) ABSTRACT

A system is provided for processing textile fibers. A bale plucker removes fiber flocks from bales of fiber material and a flock transporting system delivers the flocks from the bale plucker to a carding machine or other processing apparatus. A feed chute is configured with the card machine and includes a first part for receiving flocks from the flock transporting system, and a second part for delivering a fiber lap to the card machine. A cleaning device is disposed within the feed chute between the first and second parts. The cleaning device comprises a fine cleaning nip feed arrangement. This nip feed arrangement in the feed chute is the only fine cleaning nip feed arrangement within the system between the bale plucker and the cleaning device.

5 Claims, 13 Drawing Sheets

U.S. PATENT DOCUMENTS

| | | | | |
|---|---|---|---|---|
| 4,964,196 | | 10/1990 | Schmid et al. . | |
| 4,969,237 | | 11/1990 | Schmid . | |
| 5,025,533 | | 6/1991 | Faas et al. . | |
| 5,121,522 | * | 6/1992 | Leifeld et al. | 19/98 |
| 5,121,523 | | 6/1992 | Brutsch et al. . | |
| 5,123,145 | | 6/1992 | Schelb et al. . | |
| 5,146,652 | | 9/1992 | Leifeld . | |
| 5,168,602 | | 12/1992 | Faas et al. . | |
| 5,181,295 | | 1/1993 | Demuth et al. . | |
| 5,205,018 | | 4/1993 | Leifeld et al. . | |
| 5,228,171 | | 7/1993 | Leifeld . | |
| 5,247,721 | | 9/1993 | Demuth et al. . | |
| 5,257,438 | | 11/1993 | Faas et al. . | |
| 5,319,830 | | 6/1994 | Stäheli . | |
| 5,361,458 | | 11/1994 | Demuth et al. . | |
| 5,471,710 | | 12/1995 | Demuth et al. . | |
| 5,819,373 | * | 10/1998 | Schlichter et al. | 19/205 |

* cited by examiner

Prinzipschema Kardenfüllschacht mit Feinreinigung

PLANT FOR PROCESSING FIBERS

The present invention concerns blowroom plants for opening and cleaning fibre material as well as corresponding methods and apparatus. The invention is applicable particularly, but not exclusively, in processing cotton fibres or fibres of similar staple length.

BACKGROUND OF THE INVENTION

STATE OF THE ART

It is the general goal of fibre processing in the blowroom to enhance production and the degree of cleaning and to process the material gently minimising losses of good fibre content. The problems involved have been mentioned often in the (patent) literature, see e.g. DE-C-3490510 (U.S. Pat. No. 4,512,060).

In principle, the fibre material is cleaned in the blowroom in at least one "cleaner" before being transferred to carding. As to the lay-out of cleaners, no consistent agreement prevails. There are tendencies, however, to unite the cleaning processes "in one single machine" as far as possible—see e.g. AT-C-231054, DE-A2939861 (U.S. Pat. No. 4,345,356) and DE-A-4039773 (U.S. Pat. No. 5,146,652).

A cleaning line delivers fibre material to a predetermined number (e.g. twelve) cards. The line must be laid out in such a manner that the maximum throughput demand by the cards associated thereto can be satisfied. As the processing capacity of the individual card increases, the processing capacity of the cleaning line is to be adapted accordingly (i.e. a reduction in the number of cards associated with a cleaning line is undesirable).

TECHNOLOGY

The following principles apply to the state of the art as well as to the present invention.

1. The "fine cleaning" process implies a high degree of opening (in other words: it is not possible to eliminate trash hidden inside fibre clusters).
2. A high degree of opening implies application of "nip feeding" (to be explained in the following).
3. A fine cleaning process using nip feeding at higher throughput rates implies closer settings if good results are to be achieved. Consequently nep generation (measuring value: nep count) and fibre damage (measuring value: short fibre contents) tend to increase.
4. If gentler cleaning is attempted (less intensive—without nip feed), risks are taken that small trash particles are eliminated insufficiently and that unnecessary losses of good fibres occur. A system ("cleaning diagram") illustrating the corresponding compromises at the operating interface of the individual machine (or of the plant control) is given in EP-A-452676 (U.S. Pat. No. 5,361,458) and has been introduced to the market under the trade mark Varioset".
5. Nip feed is harmless at relatively low throughput rates. Successful fine cleaners of the 60's and 70's were based thereon, as blowroom throughput rates were relatively low at that time.

Returning to the production conditions of the 60's and 70's, certainly is out of the question (compare the notes mentioned already concerning the increased processing capacity of the individual machines) but the idea can be taken up insofar as fine cleaning can be effected at a point where the fibre material flow has been subdivided already (e.g. for subsequent carding), e.g. in a card feed chute.

DE-A-2532061:

DE-A-2532061 concerns dedusting of cotton provided for processing on open end spinning machines. For this purpose, an additional cleaning point is provided in the feed chute, i.e. the fibre material has been cleaned already according to known principles. In other words, the fine cleaning machine was not planned to be dispensed with, and this actually was not done in practical application.

According to DE-A-2532061 processing in the feed chute is to be intense—opening to the individual single fibres—for ensuring that the dust is set free and can be eliminated. Furthermore the following points are to be noted:

1. In the year 1975 (priority date of DE-A-2532061) card production was relatively low. Thus, at that time, moving the basic cleaning operation into the feed chutes did not make sense as a total production corresponding to the processing capacity of the card room could be taken care of efficiently by a conventional cleaner. It did, however, make sense to transfer the intense opening action for dedusting purposes according to DE-A-2532061 into the feed chute (relatively small quantities of fibre material, as mentioned in the document).
2. In DE-A-2532061, no "co-operation" between the feed chute and the card is mentioned.

DEFINITIONS

The term "nip feed" in this description, where used in the following without an explanation, refers to "nip feed with subsequent cleaning function" in which arrangement the elimination of material is considered as an essential characteristic of the cleaning function. This definition is discussed briefly in the following.

The nip feed is important for the finer opening (the finer cleaning) favouring the fine cleaning process. The present invention, however, does not concern the opening process as such. Insofar as the intense opening action (resolving) must be provided for other purposes than cleaning (e.g. for mixing), it is not influenced directly by the present invention. The total stress load the material is subject to, however, is reduced if the present invention is applied, from which the application of nip feeding may benefit in connection with other functions than cleaning.

A plurality of embodiments of the present invention are described in the following with reference to illustrated design examples.

DETAILED DESCRIPTION OF THE PREFERRED EMBODIMENTS

Reference will now be made in detail to one or more presently preferred embodiments of the invention. One or more examples of which are illustrated in the figures. Each example is provided by way of explanation of the invention, and not as a limitation of the invention. For example, features illustrated or described as part of one embodiment may be used on another embodiment to yield still a further embodiment.

Figure 1:
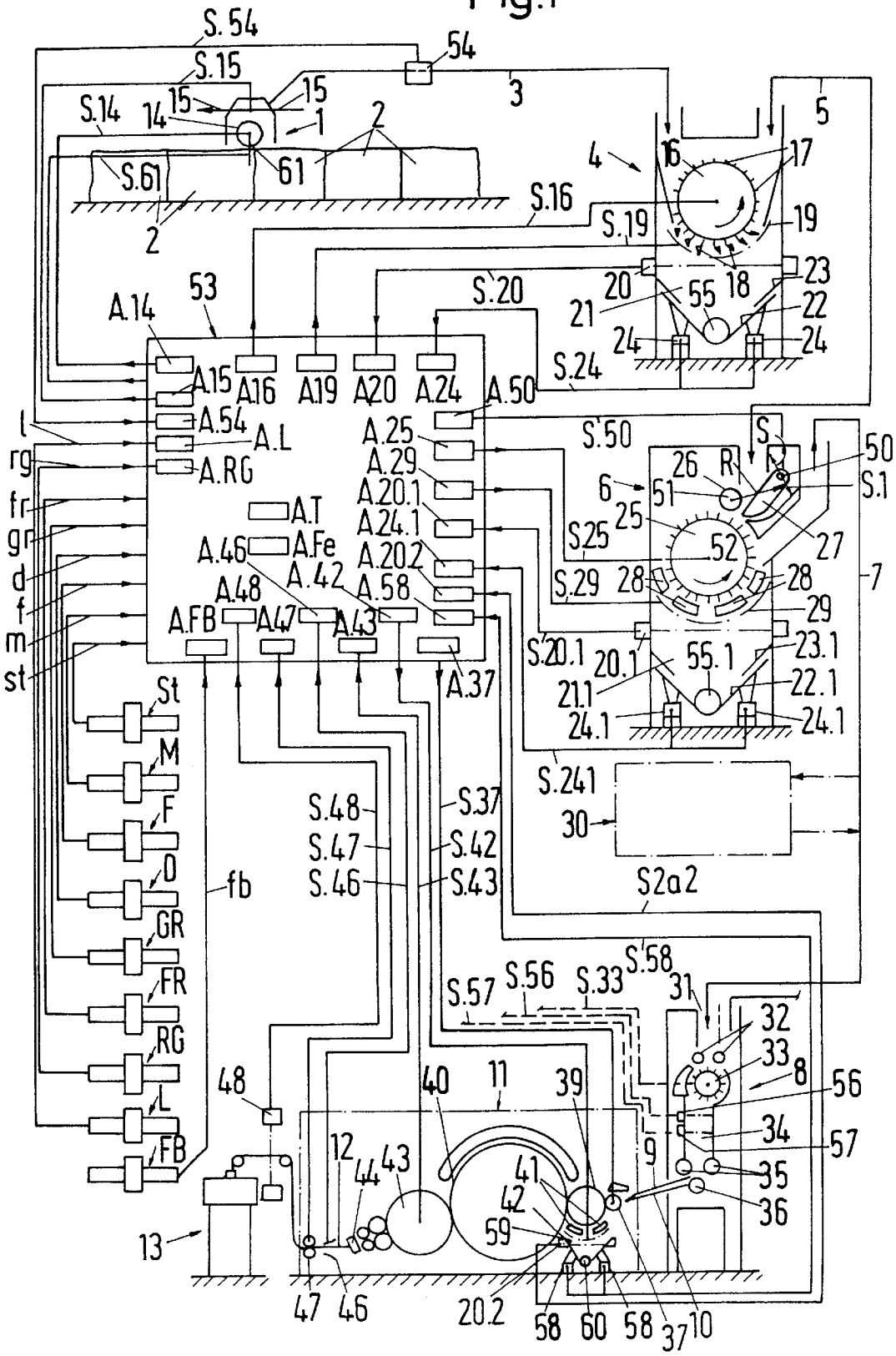
FIG. 1 is a copy of the FIG. 1 from EP-A-399315.

A blowroom plant of a design known as such is shown in FIG. 1. Fibre flocks are taken off from fibre bales 2 by means of a bale plucker 1 and are transferred via a conveying duct 3 to a first cleaning machine, e.g. a coarse cleaning machine 4. In the conveying duct 3, the quantity of flocks transported per unit time, e.g. in cubic meters per hour, can be determined using a measuring device 54. In a plant of the type illustrated, however, this measurement is dispensed with, in which arrangement reserve storage devices (feed chutes) are provided on certain machines, as to be described for the card in the following with reference to the FIG. 2.

The coarse cleaner 4 is not equipped with a feed chute but is laid out in such a manner that it can take up, process, and transfer further the maximum quantity that can be produced by the bale plucker 1. The machine 4 is not provided with a nip feed arrangement, and a description of its function can be found e.g. in EP-A379726. In any case, trash is eliminated and the fibre flocks, already much reduced in their size (i.e. at least partially opened), are conveyed via a second conveying duct 5 to a second cleaning machine, e.g. a fine cleaning machine 6, and are further opened and cleaned more intensely than in the first mentioned machine 4.

Subsequently, the cleaned flocks are transferred via a further conveying duct 7 to a feed arrangement (a feed chute) 8. From this feed arrangement 8 a fibre lap 9 is delivered via a slide 10 into a card 11. In the FIG. 1, one single card only is shown. The total production delivered by a fine cleaning machine 6, however, is subdivided in a suitable flock feed system (e.g. according to EP-A-311831 and/or U.S. Pat. No. 4,940,367) and delivered to a plurality of cards 11. It can be assumed here that all cards 11 are identical and that the description of one individual card (with reference to the FIG. 2 in the following) thus applies to the others as well.

In the FIG. 1, many more elements are shown (e.g. the control system 53 for the plant) which are important for the invention according to EP-A-399315, but are irrelevant for the present invention. A further description of these elements here is dispensed with, reference being made to the above mentioned document. The present invention described herein is not restricted to a control arrangement of the type illustrated, however, alternative solutions being shown e.g. in DE-A-3237864 and in EP-A-497535.

Figure 2:
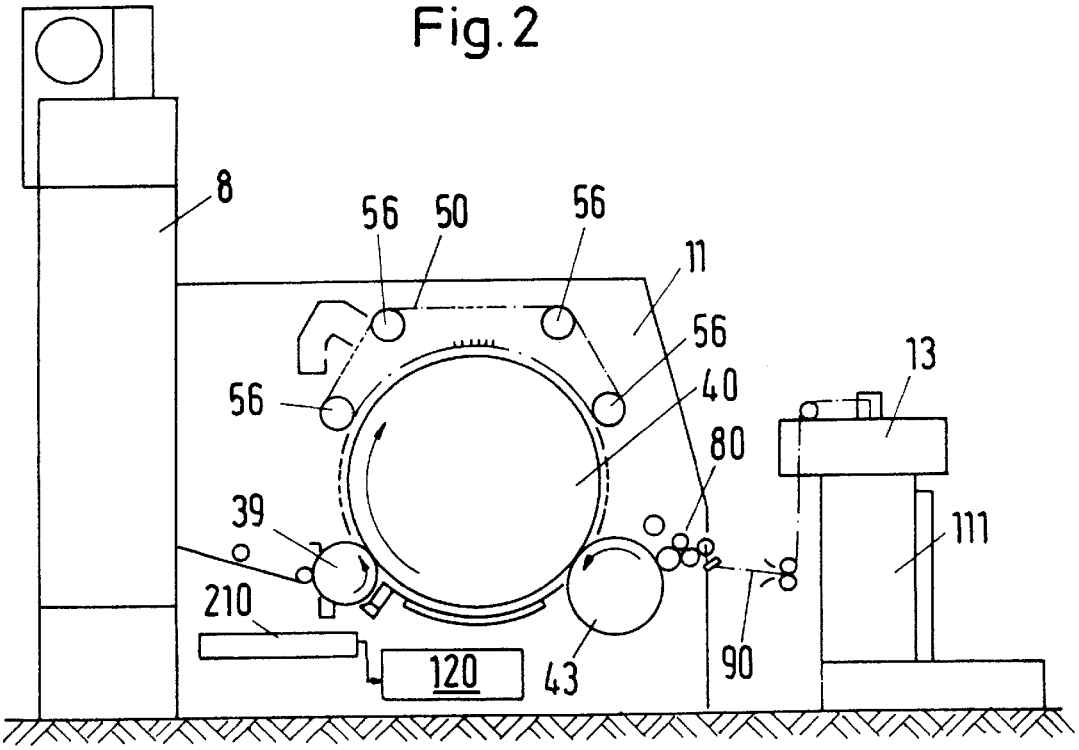
FIG. 2 is a copy of the FIG. 1 from CH 0935/96 dated Apr. 12, 1996.

In the FIG. 2, a revolving flat card known as such is shown schematically, e.g. the card type C50 produced by Maschinenfabrik Rieter. The fibre material delivered by the flock feed arrangement in flock form is fed into the feed chute 8, is taken over by a licker-in 39 (also called taker-in) as a lap, is presented to a card cylinder 40 (also called main drum) and under co-operation of the card cylinder with a set of revolving flats 50 is opened further and cleaned. The revolving flats of the set of revolving flats 50 are guided, driven by a suitable drive system for the set of revolving flats, via deflecting rolls 56 along a closed path (in the direction of the rotation of the card cylinder or in the opposite direction). Fibres from the fibre web placed on the card cylinder 40 are taken off by means of a takeoff roll 43 and, by a delivery arrangement 80 consisting of various rolls, are formed into a fibre sliver 90. This card sliver 90 is deposited by a coiler arrangement 13 in cycloid windings into a transporting can 111. The card 11 is provided with its own programmable control arrangement 120 and also a suitable "operator interface" 210 (e.g. a keyboard, and a display respectively), is provided for data input and/or output of status reports.

Figure 3:
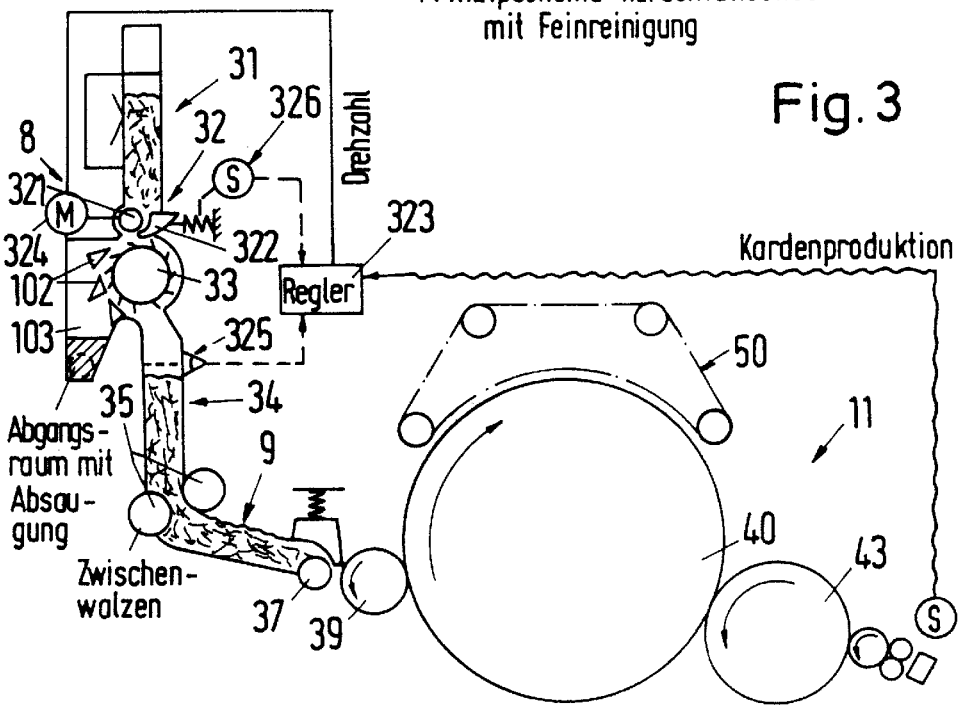
FIG. 3 is a modification of the arrangement according to the FIG. 2 forming an apparatus according to the present invention, FIG. 4 schematically shows two alternative design examples of a blowroom/carding room plant according to the present invention for processing cotton and/or chemical fibres, FIG. 5 schematically shows a blowroom/carding room plant for processing blends of cotton and chemical fibres.

In the FIG. 3 the card 11 is shown again with the feed chute 8 coordinated to it. The latter comprises an upper part (an infeed chute) 31 (compare also the FIG. 1), as well as a lower chute part (reserve chute) 34. Fibre flocks from the lower chute part 34 are delivered by two delivery rolls 35 as a lap 9 mentioned before and are transferred by the feed roll 37 to the card 11.

Between the upper chute part 31 and the lower chute part 34, a supply device 32 is arranged (compare the FIG. 1) which feeds the flocks to an opening roll 33. Devices of this type are well known in general. It now is proposed to adapt this device in order to create an apparatus according to the invention which permits substantial changes to be made in the parts of the plant arranged upstream. In principle, the supply device 32 and the opening roll 33, together with the neighbouring portion of the housing of the chute, are transformed in such a manner that they function as a "fine cleaner".

The function of this cleaner can correspond to well known principles, e.g. according to EP-A-419415 (U.S. Pat. No. 5,123,145) and/or EPA-481302, which represent more recent designs of the fine cleaner. These more modern machines permit intense cleaning action also at high throughput rates. It is not necessary, however, in an arrangement according to the FIG. 3, to apply such more modern principles, as the throughput rates in the feed chute of a card is relatively low at e.g. more than 70 kg/h, preferentially more than 100 kg/h, but far below 500 kg/h (production rate of a fine cleaner as applied today) compared to the throughput rates of a modern blowroom line. Fibre quantities of e.g. 100 kg/h and 200 kg/h can be satisfactorily cleaned according to the principles discussed e.g. in the older documents CH-C-464021, EP-A-108229 and/or EP-A-110017.

Adaptation in any case involves incorporation of elements at the circumference of the roll 33 permitting elimination of trash and impurities. In the FIG. 3 grid bars 102 are shown schematically with free spaces between them (not indicated specifically). The free spaces permit elimination of the trash into a collecting chamber 103 which can be connected to a suction system (not shown) for taking away the material eliminated. The connection to the suction system can be established continuously or, preferentially, intermittently. The present invention is not restricted to the application of the illustrated elements 102. Eliminating elements e.g. of the form of "suction assisted knifes" are known which can be applied in the arrangement according to the FIG. 3 additionally or alternatively.

The feed device 32 represents a "nip feed" for the opening roll 33, as explained in the introduction. This nip feed arrangement consists of a feed roll 321 and a through-shaped feed plate 322. Many other forms of such nip feed arrangements also are known, as e.g. can be seen from EP-A-383246 and EP-A-470577 respectively, which also can be used in the newly proposed cleaning point. In a preferred arrangement which is schematically indicated in the FIG. 3, the nip feed arrangement is laid out as a "metering" kind of arrangement according to EP-A383246. This, however, does not constitute an essential feature of the present invention.

The arrangement according to the FIG. 3 is conventional as to the transfer of the lap from the chute to the card. The new cleaning point is applicable, however, also in other arrangements, e.g. where the chute 8 is connected to the card in such a manner that the intermediate rolls 35 can be dispensed with. Arrangements of this type are shown e.g. in DE-A-3733631, DE-A-3733632 and DE-A3734140. Also a plurality of licker-in rolls 39 could be provided as proposed e.g. in DE-A-4331284.

The present invention furthermore is not restricted to an application in a revolving flat card. Also e.g. fixed flat cards are known (see DE-A-4418377), which also can be equipped with a feed chute each according to the present invention. The present invention also can be applied in combination with so-called roller cards for processing long staple fibres.

The new cleaning point preferentially is incorporated into the chute control arrangement as shown schematically also in the FIG. 3. This control arrangement as a rule comprises a control device 323 for a variable rotational speed motor 324 driving the feed roll 321. The control device 323 is connected to a filling level sensor 325, of which various types (optical or pressure sensitive sensors) are known, apt to fulfill this task, a further description thus not being required here. Using a suitable control algorithm, the filling level in the lower chute part 34 can be maintained within pre-settable tolerances. Also a sensor S can be provided at the delivery point which can be connected to the control device 323 in such a manner that the production of the cleaning point can be adapted to the throughput rate of the card. An arrangement of this type (for a feed chute without a Cr cleaning point) is known from DE-A-3625311 as well as from DE-A-3244619 (U.S. Pat. No. 4,535,511).

Also known according to the state of the art is a further alternative embodiment indicated in the FIG. 3, namely an arrangement in which a displacement or force sensor 326 is provided connected to the control device 323. The sensor measures the displacement that has occurred on the feed plate 322 or the forces exerted thereupon in order to permit some kind of a "metered supply" (e.g. according to EP-A-383246) to be effected.

It now is possible to control the card 11 and its feed arrangement (from the feed chute 8) as a "unit" for which purpose of both machines can be integrated or interconnected. An arrangement of this type proves particularly advantageous in a combination with the present invention as in this arrangement the cleaning actions effected by the card itself and by the cleaning point coordinated to the card can be mutually adapted, e.g. according to the "VARIOset" principle which is explained in EP-A-452676 and which has been supplemented in the Swiss patent application CH 935/96 dated Apr. 12, 1996.

In principle, the newly proposed cleaning point can be designed in such a manner that it is capable of processing fibre material which has not passed a nip feed of any kind previously. In any case, the cleaning point is to be conceived in such a manner that material can be processed which has not passed previously through a cleaning point provided with a nip feed arrangement. A fibre material of this type (in the upper chute part 31) should show a nep count which is less than 50% higher than the nep count in the material laid down at the bale plucker. The short fibre contents of the material in the chute part 31 can be higher by less than 5% than the corresponding value in the previously mentioned raw material (measured according to the known and proven Almeter-measuring method). The following example should clarify the latter statement—if the short fibre contents; in the bale mix laid down is X% (e.g. 30%), the short fibre contents in the upper chute part 31 should not exceed (X+5%)—in the case considered <35%.

The cleaning point provided in the chute 8 is not necessarily laid out for ensuring dedusting action, although dust always is eliminated (to a certain extent) where a suction action is applied. The newly proposed cleaning point should not be laid out in such a manner that opening to the individual single fibre is aimed at. Such an elevated degree of opening in the chute is undesirable.

Particularly if chemical fibres are to be processed, a coarse cleaning step (machine 4, FIG. 1) possibly can be dispensed with altogether. In this case it may prove advantageous, however, to provide an additional opening point (possibly with a nip feed but without trash elimination) in the plant, e.g. in a blending machine (not shown in the FIG. 1). In any case, fine cleaning upstream from the card feed chute 8 (i.e. the machine 6, FIG. 1) can be dispensed with.

Figure 4:
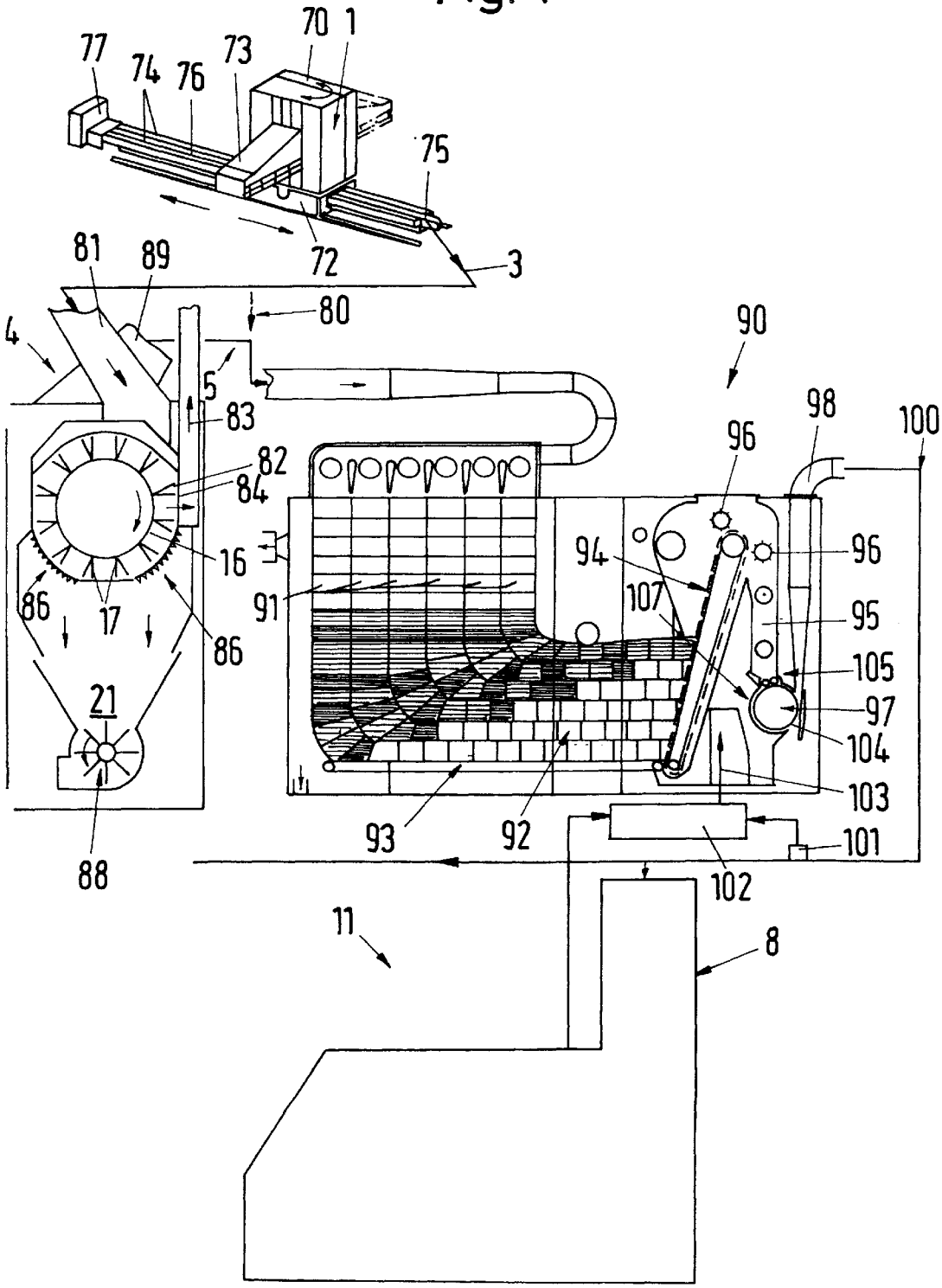

In the FIG. 4, three blowroom machines 1, 4, 90 are shown arranged in a line followed by a card 11 of a group of cards supplied with fibre material from the blowroom line. The various machines illustrated are shown in different scales, the FIG. 4 aiming merely at explaining the processing steps. These steps first are described for the processing of a fibre blend consisting of 100% cotton, and in the following an alternative arrangement is described in which a fibre blend consisting of 100% chemical fibres is processed. The card 11 and its feed chute 8 are laid out as shown in the arrangement according to the present invention illustrated in the FIG. 3 and thus are indicated here in their outlines only.

The reference sign 70 refers to the swivel tower of a bale plucker 1. The tower is pivotably mounted on a movable carriage 72 and supports a plucking arm 73 of known design plucking or milling off fibre flocks from the bales laid down (not shown in the FIG. 4, but compare bale 2 in the FIG. 1). The carriage 72 is arranged movable along rails 74 along a conveyer duct 75, the bales mentioned before being laid down to one or the other side, or to both sides respectively, of the rails, in which arrangement the plucker arm 73 contacts the top surface of the bale. In the duct 75, a transporting air stream is generated by suitable means (not shown). The arm 73 comprises at least one rotatable plucker or milling roll (not shown) which takes off the fibre flocks and supplies them via a connecting duct (not visible in the FIG. 4) in the tower to the conveyer duct 75. The conveyer duct 75 is covered by an endless cover belt 76 which together with the carriage 72 moves in longitudinal direction of the duct 75. At one end of the path of movement of the carriage, a control desk 77 is arranged. The bale plucker 1 according to the FIG. 4 in principle is of a conventional type, e.g. a "UNIFLOC" type machine, which is marketed worldwide by Maschinenfabrik Rieter, similar machines being offered by other textile machinery producers, which machines can be applied in this first processing step.

As indicated schematically by the arrow shown with solid lines, the conveyer duct 75 merges into the transporting duct 3 (comp. FIG. 1) which leads to the intake 81 of a coarse cleaner 4. The stream of air/fibres then first flows through a dedusting zone 82 where a part 83 of the air stream is eliminated via a perforated wall 84. The remaining flock/air stream is guided on a spiral path around a drum 16 which is provided with a beater 17, in which arrangement part of the impurities carried on drop through grids 86 into a chamber 21 arranged below the grids. From this chamber 21 the collected impurities can be eliminated using a transporting suction action (not shown) via an air lock 88. The intake opening for the fibre/air stream is provided at one axial end of the perforated drum 84 and an outlet is provided at the other end of the drum 84. Further details concerning this machine are described e.g. in EP-C-381860, EP-C- 379726, EP-C-447966 and EP-C-455017, a machine of the type mentioned being marketed under the name "UNICLEAN". The most important feature of this machine is, that in the second processing step the cotton flocks are cleaned in free flight (without being nipped or held back). Machines marketed by other manufacturers are conceived also for cleaning the flocks by beating them in free flight, in some of which arrangements a plurality of rolls (e.g. "Duorolls") are arranged side by side. Machines of this type can be applied also in the second processing step in processing cotton fibres.

From the coarse cleaner 4, the fibre flocks are conveyed by the pneumatic transporting system via the duct 5 (compare the FIG. 1) to a blending machine 90. The machine 90 comprises a plurality (six in the design example illustrated) vertically arranged drop chutes 91 where the flocks are separated from the transporting air. All chutes are connected via a common inlet with the transporting duct 5 in such a manner that each chute 91 takes up fibres from the same supply batch.

The drop chutes 91 merge into a blending chamber 92 where the fibres are carried on by a horizontal transporting belt 93 against an inclined transporting means (e.g. a belt with needled slats) 94. The transporting means 94 takes fibres from the blending chamber 92 and transfers them to a drop chute 95 in which arrangement rolls 96 co-operate with the transporting means in such a manner that fibre lumps are thrown back into the blending chamber, or are opened respectively. Owing to the different path lengths the fibres cover in the various chutes 91 and in the chamber 92 until they reach the transporting means 94 a phase shift occurs while the different "fibre portions" are transported as indicated schematically in the FIG. 4. This phase shift results in a blending of the fibres which were taken off the bales in a sequence from different bales. The basic principle of the function of this machine has been described in CH-C-511951, a more modern version of this machine being marketed under the name of "UNIMIX". Alternative solutions also in this case are proposed by other manufacturers for fulfilling the same function, which arrangements can be laid out in such a manner that a so-called doubling effect (e.g. according to DE-A-3151063) is achieved. Machines of this type are apt also to effect the third processing step (the blending step) according to the present invention.

The machines in the arrangement of the blowroom line described thus far with reference to the FIG. 4 all are of conventional design and their known effects remain unchanged. The chute 95, however, is followed by a delivery unit 97 which in the plant illustrated must be changed according to the present invention as will be explained in the following.

In plants known thus far the unit 97 delivers flocks to a tube 98 merging into a pneumatic transporting system for transferring the flocks to a fine cleaner 6 (FIG. 1). The fine cleaner 6 often also serves as a feeder machine for the flock feed system to the card room (see duct 7, FIG. 1). According to the present invention, however, no "fine cleaning machine" is provided as a separate blowroom machine. The delivery unit 97 thus must take over the function of a feeder machine, and the delivery tube 98 thus merges into a duct 100 via which the flocks are conveyed to all the cards of the group of cards coordinated to the feeder machine. In the FIG. 4 merely one card 11 of this group is shown, the continuation of the duct 100 supplying flocks to further cards being indicated.

The flock feeding system for the cards as such is not influenced by the present invention and thus is not explained in all details here. But the flock feeding system requires a control system, for which in the FIG. 4 a sensor 101 and a control unit 102 according to EP-C-303023 are shown, which unit 102 also receives signals from the cards and correspondingly regulates the feeder machine (delivery unit 97), which is indicated schematically with the circuit 103 and is explained in the above mentioned EP document. If the feeder machine is working according to the so-called stop-and-go mode, which is not relevant in the context of the present invention, the control system also can be laid out according to EP-C311831 in order to permit "stop-and-go optimising".

The delivery unit 97 (as illustrated in the FIG. 4) itself represents an opening point as it comprises an opening roll 104 with a nip feed arrangement (in the form of a pair of feed rolls 105). In another known alternative design, the delivery unit 97 consists of a direct (by-pass) connection between the chute 95 and the tube 98 if the fibre material in process does not require opening action at this point. The delivery unit 97 in any case is laid out preferentially as a controllable unit which can take over the flock feeding function, as otherwise an additional feeding machine would have to be provided. The controllable unit also could consist of the chute 95 and the pair of feed rolls 105 (without the opening roll 104) in which arrangement the pair of feed rolls 105 delivers the fibres directly into the transporting air stream which is generated by suitable means (not shown) in the tube 98 and the duct 100 respectively. This signifies that the plant now can be laid out without a nip feed point being provided upstream of the card feed chute.

The delivery unit shown in the FIG. 4 being integrated into the blending machine of course could also be designed as a separate module which takes the fibres from the blending machine and delivers them in a controlled manner.

In processing chemical fibres (also called synthetic fibres), no cleaning of the material to eliminate impurities is required, i.e. the coarse cleaner 4 also is not required. In this case transfer can be effected from the duct 3 directly into the duct 5 which is indicated with the arrow 80 shown in dashed lines in the FIG. 4. But in this case it proves advantageous to design the delivery unit 97 as an opening point.

Figure 5:
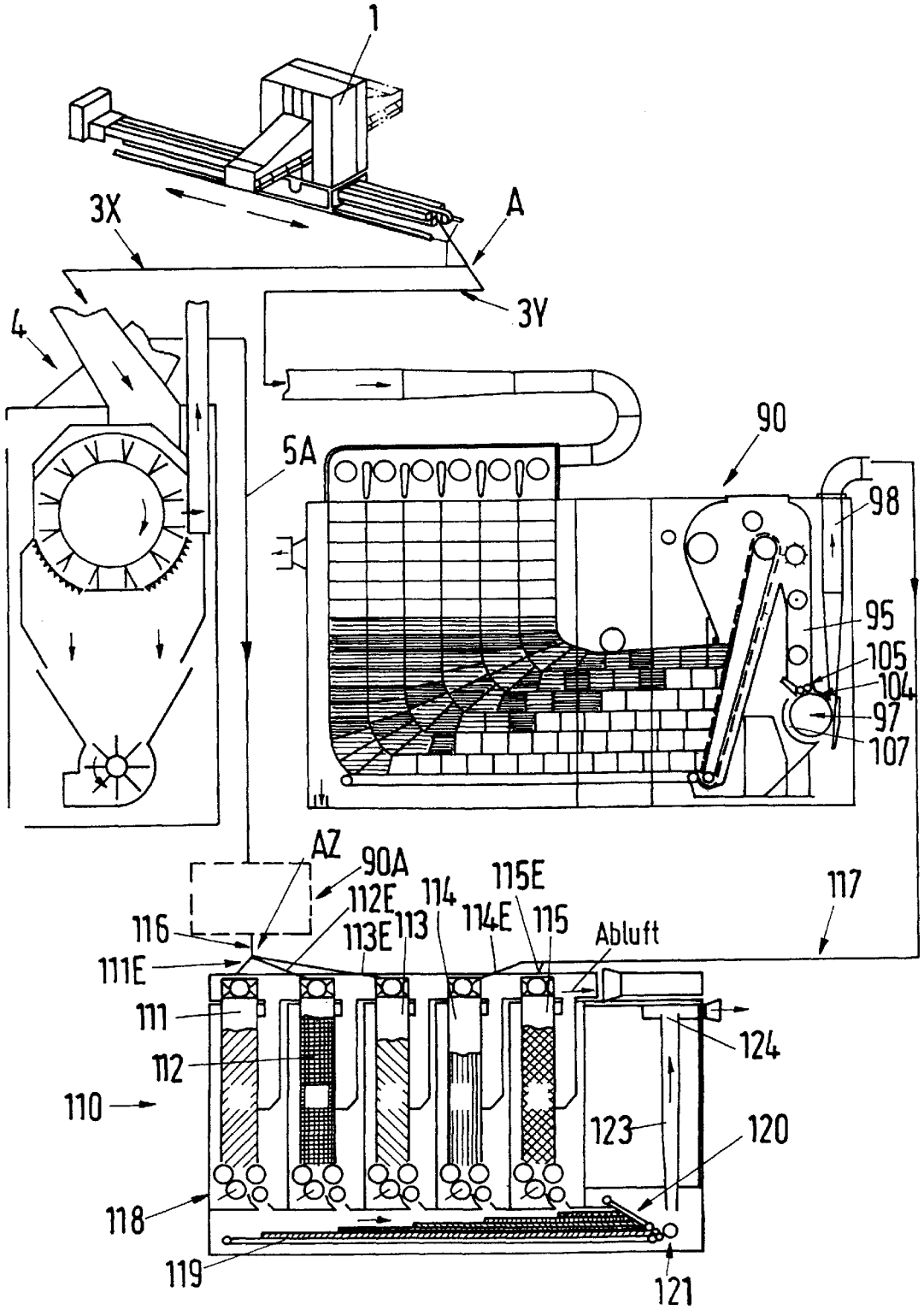

In the FIG. 5, a blowroom plant is shown conceived in such a way that cotton and synthetic fibres can be blended and transferred to a card room (not shown in the FIG. 5) according to the present invention. The plant comprises a bale plucker 1, a coarse cleaner 4 and a blending machine 90, in a configuration which differs, however, from the one shown in the FIG. 4. The duct 3 now is provided with a branching arrangement A (a controllable flap) via which flocks can be conveyed selectively to the coarse cleaner 4

(via the branch 3X) or to the blending machine 90 (via the branch 3Y). The working zone of the bale plucker 1 is subdivided into "blocks", in which arrangement each block can be occupied by "its own" fibre (cotton or synthetic fibres, such as Polyester) type (for a process of this type compare e.g. EP-C-221306).

The flocks of the cotton fibre material(s) to be processed contain impurities which are to be eliminated as far as possible. The cotton flocks thus are conveyed to the coarse cleaner 4. The flocks of the synthetic fibres to be processed on the other hand do not contain any particles to be eliminated. They thus are conveyed directly to the blending machine 90. In order to operate in the manner cited (using only one bale plucker 1), the flap mentioned above is controlled as a function of the position of the plucker arm 71 relative to its working zone. The delivery unit 97 of the machine 90 comprises guide elements 107 which guide the fibre material from the chute 95 to the tube 98, in which arrangement owing to the co-operation of the opening roll 104 with the pair of feed rolls 105, this fibre material is opened, i.e. the flock size is reduced further. The delivery unit 97 in this case, however, does not serve as a feed machine for the card room, as the synthetic fibres are to blended in with the cotton fibres before being subject to the carding process. The latter processing step is effected in the blending machine 110 which works according to EP-A-628646, or EP-C-383246 respectively.

I The machine 110 comprises also a plurality of drop chutes (five in the example illustrated) 111 through 115 in which the flocks are separated from the transporting air stream. These chutes are not (as the chutes 91, FIG. 4) connected to a common inlet, but they are provided each with a separate inlet 111E, 112E, 113E, 114E, and 115E respectively. The chutes of the machine 110 thus can be individually supplied with fibres, in the illustrated example with five different types fibre. In order to simplify the illustration only two ducts 116, and 117 respectively (one 116 for cotton, and the other 117 for synthetic fibres), are shown in which arrangement a separate feed duct could be coordinated to each chute 111 through 115. If this duct, like the duct 117, is connected to a blending machine 90, a blending machine must be provided for each type fibre. An alternative design example comprising a blending machine 90A connected to the duct 116 is indicated by the box shown with dashed lines, in which arrangement only one cotton fibre type can be supplied to the three chutes 111, 112, 113. If blending upstream of the machine 110 can be dispensed with, it would be possible to send different types cotton fibre sequentially via a common duct 5A to a chute 111, 112, 113 each, using a flap at the branching point AZ. In a case like this one, it proves advantageous to set the coarse cleaner 4 separately for each type fibre to be processed, e.g. according to EP-A-641870. Also in processing a single type cotton fibre the additional blending machine 90A possibly could be dispensed with, if the three chutes 111, 112, 113 of the machine 110 together with the arrangement 120, 121 sufficiently take care of the blending action (with the help of doubling). These notes should make clear that the plant lay-out while being flexible still must be adapted to the actual requirements.

Each chute of the machine 110 is provided with a metering device 118 (indicated only on the chute 111, the other chutes being identical) at its lower end. The function of this device 118 is described in EP-C-383246 and is not re-described herein. The metering devices 118 each build a fibre layer on a common transporting belt 119 which transports the material to a condensing device 120 which in turn compacts the fibre material into a lap composed of five layers. The lap is delivered to a (schematically indicated) opening unit 121 where again flocks are formed and delivered via a tube 123 on to a fan 124. The air stream generated by the fan 124 can be used for carrying the fibre flocks on. The delivery unit 120, 121, 123, 124 as shown in this example serves as a feed machine for the card room.

The present invention thus provides a plant in which the flock feeding to the card room is effected by means of regulating the fibre material flow delivered by a blending machine which also is provided in EP-C-361276. The plant according to the present invention differs in many aspects from the one proposed in EP-C361276, e.g. in that:

- in the feed unit a nip feed arrangement without an associated elimination of trash material can be provided,
- no cleaning action is to be provided in the free flight of the flocks between the controllable feed unit and the card room,
- a cleaning function can be performed in the card feed chute, it is not necessary to take off excessive material from the upper part of the feed chute when the card is stopped.

These features can be applied individually or in any combination desired to a plant which differs in its structure as well as in its function from the plant according to EP-C-361276.

DEGREE OF CLEANING, NEP COUNT COURSE, DEGREE OF OPENING

Figure 7:
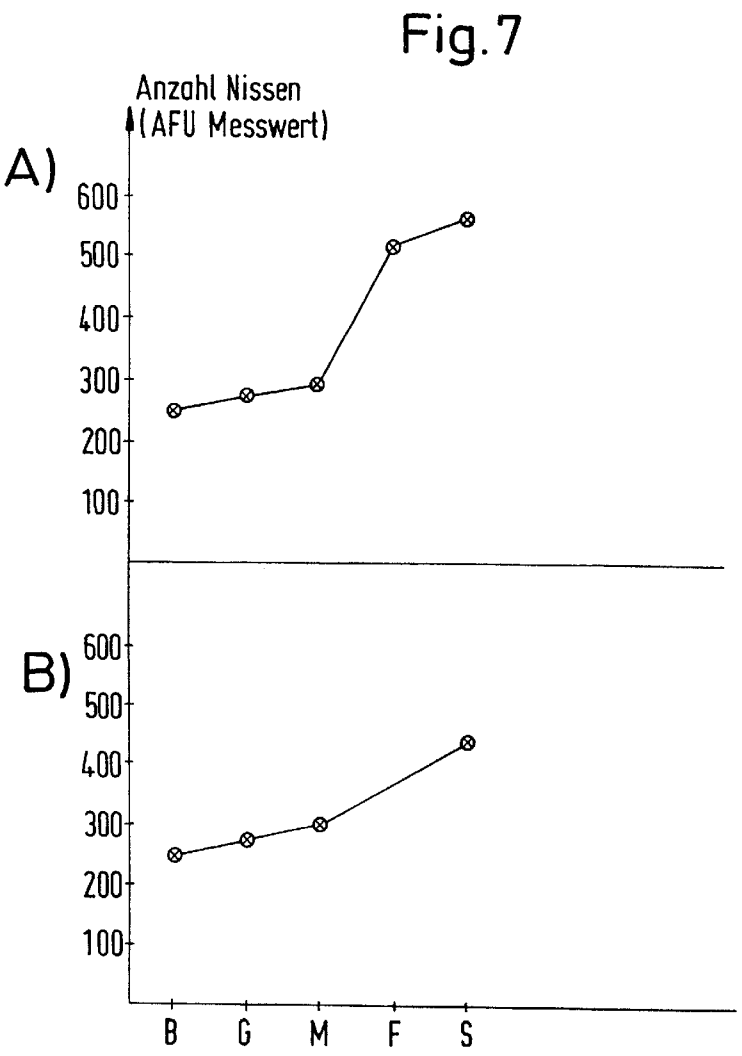
Figure 6:
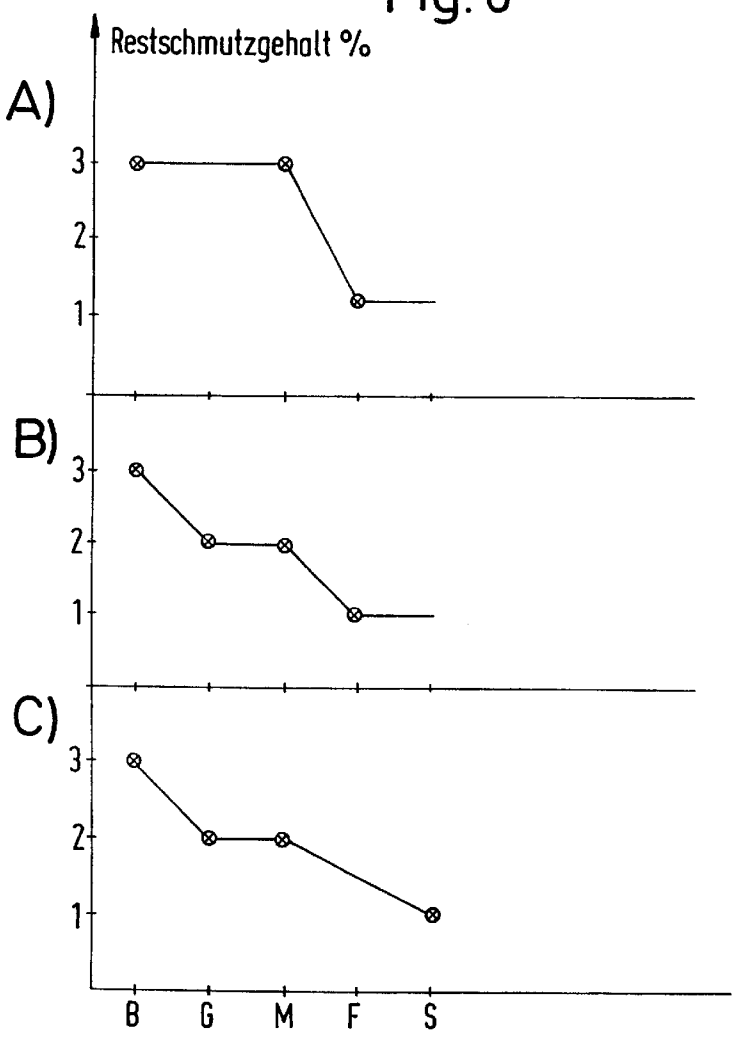
FIG. 6 is a diagram of the cleaning process in a blowroom comparing the process according to the present invention with processes in conventional blowrooms, FIG. 7 illustrated diagrammatic curves of the corresponding nep count values.

In the FIG. 6 three diagrams A, B, C are shown which each display the course of the degree of cleaning in three different configurations of the blowroom processing line. Diagram A (upper diagram) corresponds to a blowroom plant ("blowroom I") in which the cleaning function is concentrated in one single step. Diagram B corresponds to a blowroom processing line ("blowroom II") in which the cleaning function is subdivided into a plurality of steps. Diagram C corresponds to a blowroom processing line ("blowroom III") according to the present invention. Each of the diagrams starts out from a trash contents in the bales (stage B) in the order of 3%. In each of the diagrams, the stages coarse cleaning (G), blending (M), fine cleaning (F) and reserve chute (S, in the card feed chute) are listed even if in the blowroom plant I no coarse cleaner and in the blowroom plant III no fine cleaner are present. The diagram "curves" interconnect measured values, each measuring value representing the remaining trash contents at the delivery point of the stage concerned. In the FIG. 7 two diagrams are shown each of which displays the course of the nep count for the blowroom processing line 1/11, and the blowroom processing line III respectively, each diagram starting out from an initial nep count value in the bales of the order of 250. The courses of nep count values being about equal for modern blowroom processing lines I and II, an average value for such blowroom processing lines merely is shown in the FIG. 7.

The degree of opening is not displayed separately. But the course of the degree of opening approximately corresponds to the course of the nep count value. In other words, the nep count tends to increase with increasing degrees of opening, as it is "easier" to roll up well opened fibres into neps. Thus it is an advantage of the arrangement according to the present invention that the step of "fine opening" is effected relatively late in the process. The fibres thus can be transported via the transporting ducts in the form of rather coarse flocks which reduces nep formation in these ducts.

The nep count value also depends on the throughput quantity rates at the opening stage. Subdivision of the total quantity of fibre material to be processed to the card feed chutes before fine opening is effected thus presents an advantage in avoiding nep formation.

NIP FEED

In the following various examples of nip feed arrangements are discussed in more detail. These examples show the following common features:

FR 1 The fibre material to be processed is supplied in the form of a lap, e.g. layers of flocks.

This lap can be formed extending across the full working width. Its density should be as uniform as possible across the working width as well as in the longitudinal direction, but variations in density within pre-set limits, however, normally are unavoidable (under reasonable efforts), and thus the fibre material is supplied to an opening roll.

The material to be supplied in most cases is taken from a pneumatically transported flock stream, which requires separation of the flocks from the transporting air. Drop chutes have proven best suited for this purpose over the past thirty years.

FR2 The feed speed is relatively low (e.g. lower than 0.5 m/s and typically lower than 0.1 m/s at supply rates ranging from 200 to 500 kg/h).

FR3 The material to be supplied is taken through a nip line (or a nip zone respectively) which exerts a retaining force onto the material. The nip effect is to be distributed across the working width as uniformly as possible. The nip line can be created using various means as explained in the following with reference to the FIG. 8.

FR4 The fibre path between the nip line and the subsequent opening roll, or cleaning roll respectively, is shorter than 100 mm if fibres of a mean fibre length of up to 60 mm are to be processed. This parameter will be discussed in more detail in the following with reference to the FIG. 8. Owing to the feature FR4 good opening performance is ensured as the opening roll can pull fibres out of the material supply without tearing them.

The features FR1 through FR4 mentioned above equally apply to a nip feed arrangement provided in an opening unit as well as to one provided in a cleaning unit. Nip feeding or fine cleaning can be compared with the corresponding features of coarse cleaning:

GR1 Fibre material is supplied in flock form,

GR2 Supply speed is relatively high at >5 m/s,

GR3 Flocks are cleaned in free flight (not being retained, i.e. without a nip line).

In the FIGS. 8A through 8J different embodiments are shown schematically as examples of a feed device 32 with a nip feed arrangement. The various embodiments additionally are conceived as metering devices according to EP-B383246, which is not essential in the context of the present invention, however. If the metering function is not required in a specific case, the feed device can be simplified accordingly as measurement of the distance "X" in the nip feed gap, to be provided according to according to EP-B-383246, is not required here. Also, if metering is provided, it possibly is sufficient for an application in a card feed chute to measure a volume flow (rather than a mass flow). In cases of this type it is possible to dispense with particular measures aimed at maintaining constant density of the fibre material in the nip feed gap.

In the FIG. 8K then a simplified alternative solution (without metering) is shown.

In the illustrations given in the FIGS. 8A through 8K, the distance between the nip line and the point where the fibres are taken over (in the sense of EP-A419415) is given as "P" in each case. This distance (according to the feature FR4 mentioned above) for processing "short staple fibres" (cotton and chemical fibres of corresponding staple lengths) is chosen smaller than 100 mm and preferentially ranging from 14 mm to 40 mm. The "cleaning parameter" P according to EPA-419415 can be adjustable in such a manner that the parameter can be adapted to the fibres to be processed. The parameter P can be rendered adjustable using a control system based on a set of characteristic curves of cleaning action according to EP-A-452676.

Figure 8A:
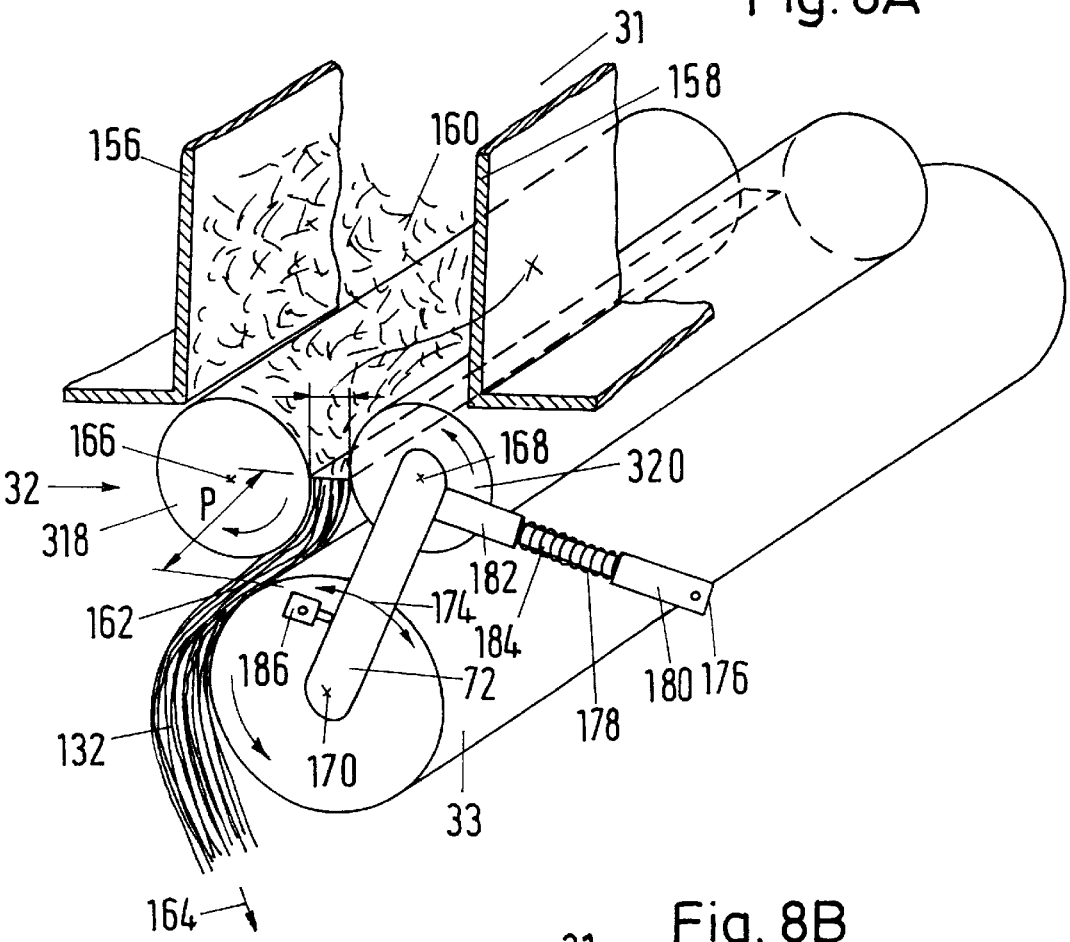
FIGS. 8A through 8J show various nip feed arrangements, FIG. 9 schematically illustrates a first possibility of realising the cleaning function in a feed chute according to the FIG. 3, FIG. 10 schematically shows a further possibility, details being shown at an enlarged scale in FIG. 10A, FIG. 11 a third possibility, and FIG. 12 the fibre material feed arrangement with a feed chute according to the present invention.

The arrangement of a metering device 32 with feed rolls 318, 320 and the opening roll 33 is shown in the FIG. 8A.

The two side walls 156, 158 of the flock chute extend into close vicinity of the feed rolls 318, and 320 respectively, and mutually diverge slightly in such a manner that formation of flock congestion is prevented. The flocks 160 in the chute 3 are taken over by the feed rolls 318, and 320 respectively, which rotate in the direction of the arrows in opposite directions, and are compressed into a flock lap 162. The opening roll 33 thereupon takes the flocks off from this lap and generates a flock stream 132, which moves on in the direction of the arrow 164. All flocks carried on by the feed rolls rotating at a rotational speed n are transported via a transporting gap the height x of which forms the smallest distance between the two feed rolls, the width of which gap corresponds to the working width of the feed rolls, or to the width of the side walls respectively of the chute.

The rotational axis of the feed roll 318 is designated 166, and the rotational axis of the feed roll 320 is designated 170. The rotational axis 166 of the feed roll 318 as well as the rotational axis 170 of the opening roll 33 are fixedly arranged in the flock feed chute. The rotational axis 168 of the feed roll 320 on the other hand is supported by two arms 172, one of which only is visible in the Figure. The second arm 172 is arranged at the other face side of the feed roll 320 and is identical to the arm 172 shown. This arm 172 is supported on the opening roll 33 and thus can pivot about its rotational axis 170 in the directions of the double arrow 174. As can be noticed, such pivoting movements result in a change in the distance x.

On the right hand side of the Figure a pre-tensioning device 176 is provided in the form of a pre-tensioning spring 178 which with one of its ends rests against a stop 180 fixedly located on the feed chute and with its other end rests against a stop 182 connected to the arm 172. Between the stop 180 and the stop 182 a rod 184 extends which is adjustably arranged within the stop 182. Of course at the other face side of the feed roll 320 a second pre-tensioning device is arranged which also exerts pressure onto the arm 172. The two springs 178 thus tend to diminish the distance x. The minimum distance x is determined by a stop device 186 which cooperates with the arm 172 shown. A further stop device is provided at the other face side of the feed roll 320 and there cooperates correspondingly with the arm 172 arranged there.

During operation the distance x adjusts itself according to the pressure prevailing in the feed chute, to the density and the degree of opening of the flocks, and the force exerted by the springs 178, in which arrangement the measure of the distance x can be checked by scanning the shifting movements of the rod 184 within the stop 182. The rod 184 and the stop 182 thus are designed as a distance measuring device.

The metering method and the control action performed have been explained in EP-C-470577.

Figure 8B:
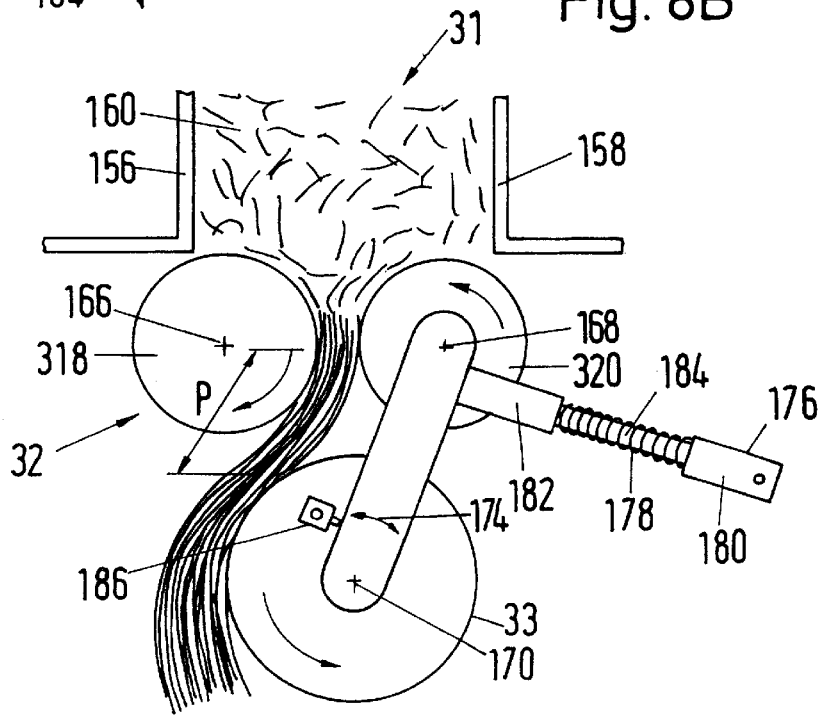

In the FIG. 8B an embodiment is shown which closely resembles the embodiment shown in the FIG. 8A, but in which the feed roll 318 no longer is driven separately but is arranged freely rotatable. This arrangement is based on the finding that the flock stream driven by the feed roll 320 exerts considerable friction forces onto the feed roll 318, particularly if the surface of the feed roll 318 is not smooth but is provided with a surface structure which causes an increase in the coefficient of friction, these friction forces being entirely sufficient to drive the feed roll 318 at a surface speed corresponding to the speed of movement of the flock stream, and to the surface speed of the feed roll 320.

Except for the change mentioned, the lay-out of the embodiment according to the FIG. 8B most closely resembles the embodiment according the FIG. 8A, for which reason the same reference signs are used to designate the same elements, and a separate description of these elements is not required. It will be sufficient to note that the rotational axis 166 of the feed roll 318 is fixedly arranged whereas the feed roll 320 is driven in the direction of transport. The inverse arrangement also would be possible, in which only the feed roll 318 is driven and the other feed roll 320 is laid out freely rotatable.

Figure 8C:
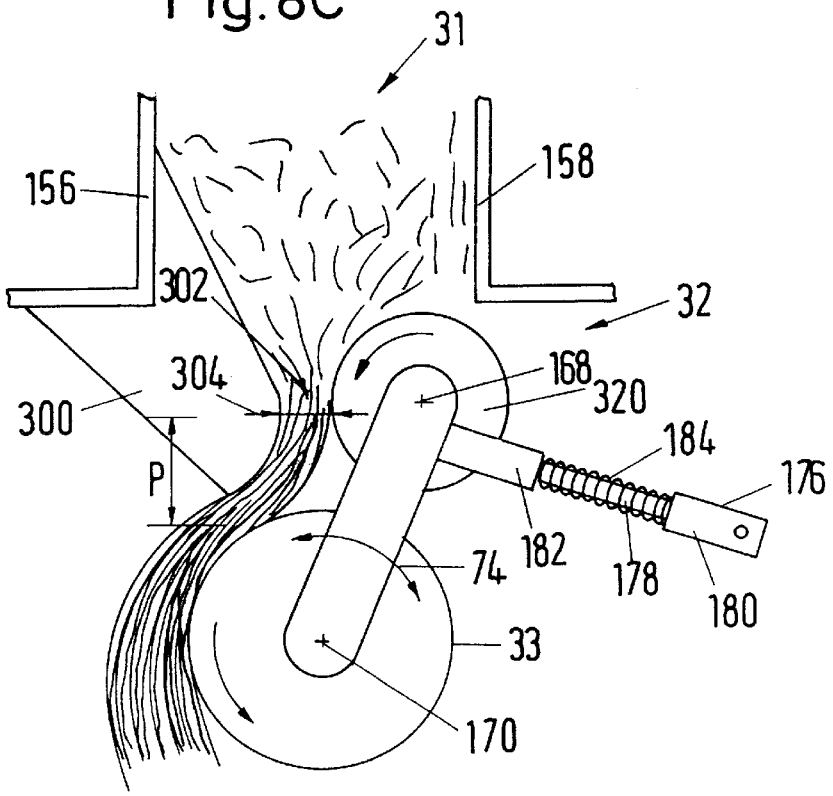

In the embodiment according to the FIG. 8C, the arrangement of the opening roll 33 and of the driven rotatable feed roll 320 remain unchanged, the same reference signs being used again for these elements. But the feed roll 318 is replaced by a fixedly arranged slide plate 300 which together with the feed roll 320 forms a feeding gap 302 the height of which is minimum at the point 304.

Figure 8D:
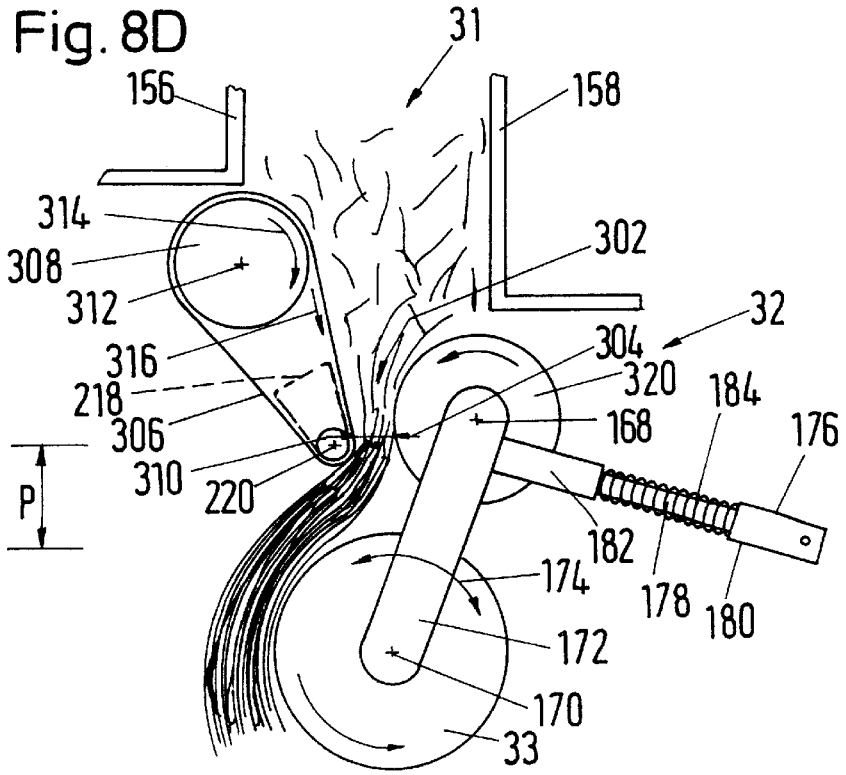

In the embodiment according to the FIG. 8D, the slide plate 300 is replaced by a revolving belt 306 which is guided around two deflecting rolls 308 and 310. The upper deflecting roll 308 is driven as shown in this example and rotatable about an axis 312, namely in the direction of the arrow 314 at a speed at which the surface speeds of the belt 306 in the direction of the arrow 316 and the surface speed of the rotatable feed roll are equal. The arrangement of the rotatable feed roll and of the opening roll 33 correspond to the arrangement shown in the FIG. 8A, the same reference signs being used. This arrangement is not described further here for the sake of a shorter description.

In the case of a revolving belt 306, provision of a deflecting roll in the lowest portion of the loop formed by the belt is not necessarily required. Instead, the belt can be guided over a triangular guide body 218. In this design example it also is feasible not to drive the belt at all, as it can be moved under the influence of the friction forces exerted by the flock stream. In such a case it is desirable to provide a deflection roll 310 which is freely rotatable about the axis 220 in addition to the deflection roll 308 which in this case also is freely rotatable in order to keep the friction hindering free movement of the revolving belt as low as possible. The minimum height 304 of the feed gap 302 in this example also is located at the lower end of the revolving belt.

Figure 8E:
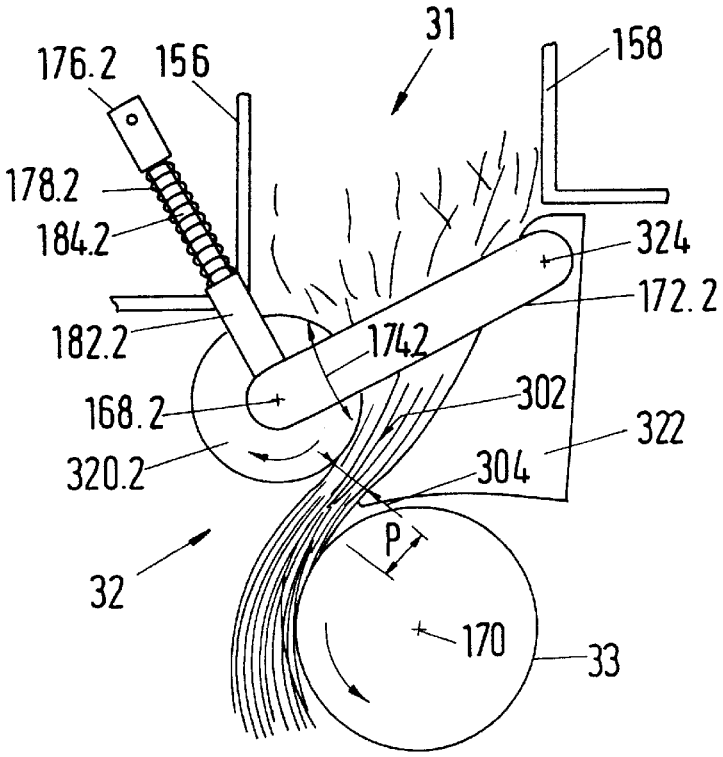

In the FIG. 8E, an embodiment is shown with a driven feed roll 320.2 and a fixedly arranged feed plate 322. The feed roll 320.2 is rotatable in the direction of the arrow about the rotational axle 168.2, and the rotational axle 168.2 at both its ends is supported by the corresponding arm 172.2 each, both arms 172.2 (one of which only is visible in the FIG. 8E) being linked at the upper end of the feed plate 322 to the rotational axle 324. The feed gap 302 in this example shows its minimum height at the point 304. This arrangement of the feed roll 320.2 permits changes in the minimum height to be effected at the point 304 by means of pivoting movements of the arms in the direction of the arrows 174.2. The pre-tensioning arrangement 176.2 is designed according to the one shown in the FIG. 8A but extending from the top it rests against the lower end of the arms 172.2 and thus presses the feed roll in the direction of the feed plate 322.

Figure 8F:
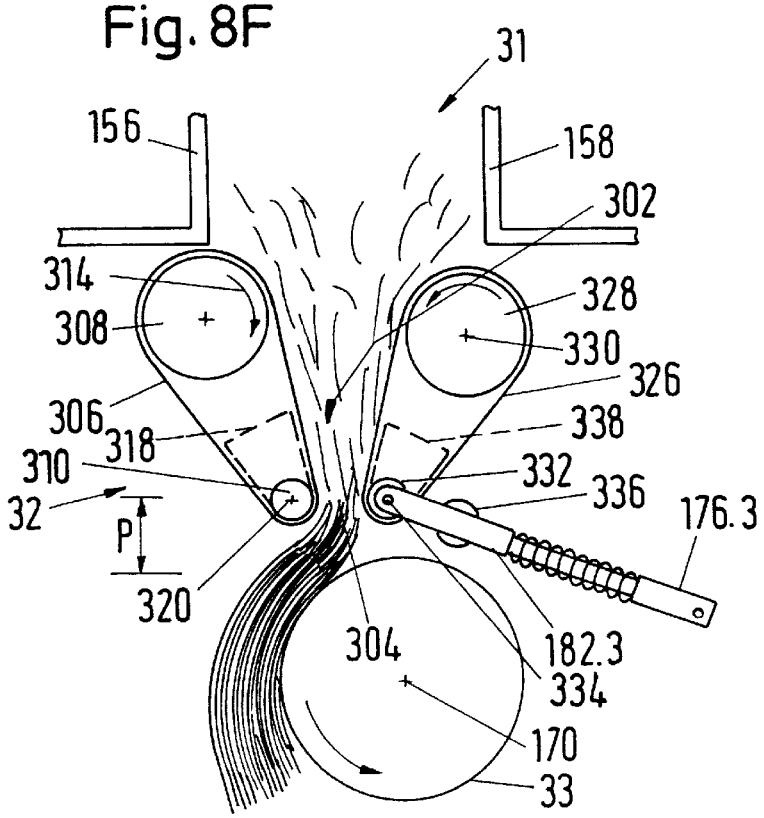

In the embodiment shown in the FIG. 8F, both feed rolls are replaced by revolving belts 306 and 326. The arrangement of the belt 305 revolving about the deflecting rolls 308 and 310 exactly corresponds to the arrangement of the corresponding revolving belt 306 shown in the FIG. 8D, for which reason in this arrangement the same elements are designated by the same reference signs, and the arrangement is not described further here. The revolving belt 326 is laid out in similar manner, i.e. it revolves about an upper deflection roll 328 which is driven and which rotates about an axis 330. The revolving belt 326 also is guided around a lower deflection roll 332 which rotates freely about a rotational axle 334. Onto both ends of this axle 334 a pre-tensioning device 176.3 acts which is laid out substantially corresponding to the ones shown in the preceding Figures, an additional measure being taken, however, in that the elements 182 at both ends of the rotational axle are interconnected mutually via a solid rod 336 which ensures that the gap height at the narrowest point 304 of the feed gap 302 is maintained constant over the full axial length of the deflecting rolls 310, and 332 respectively. A rod 336 of such type also can be incorporated also in the other embodiments shown. The rotational axle 330 of the deflecting roll 328, as well as the rotational axle 334 of the roll 332 are mounted onto a common support member (not shown) pivotable about the axle 330.

In this example either both revolving belts are driven at the same surface speed or if desired only the revolving belt 306 or the other revolving belt 326 is driven and the other belt can revolve freely. In the case in which freely revolving belts are provided, the lower deflection point preferentially is to be designed as a freely rotating roll. In the case of driven belts also deflecting bodies like e.g. 318 or 338 can be provided in which arrangement the deflecting body 318 can be arranged fixedly and the deflecting body 338 movably. In this arrangement the mobility of the deflecting body 338 is limited to a pivoting movement about the axis 330. Also in this example the minimum height 304 varies during operation, and such changes in this distance are taken into account in the regulation of the surface speed of the driven revolving belt, or belts respectively.

Figure 8G:
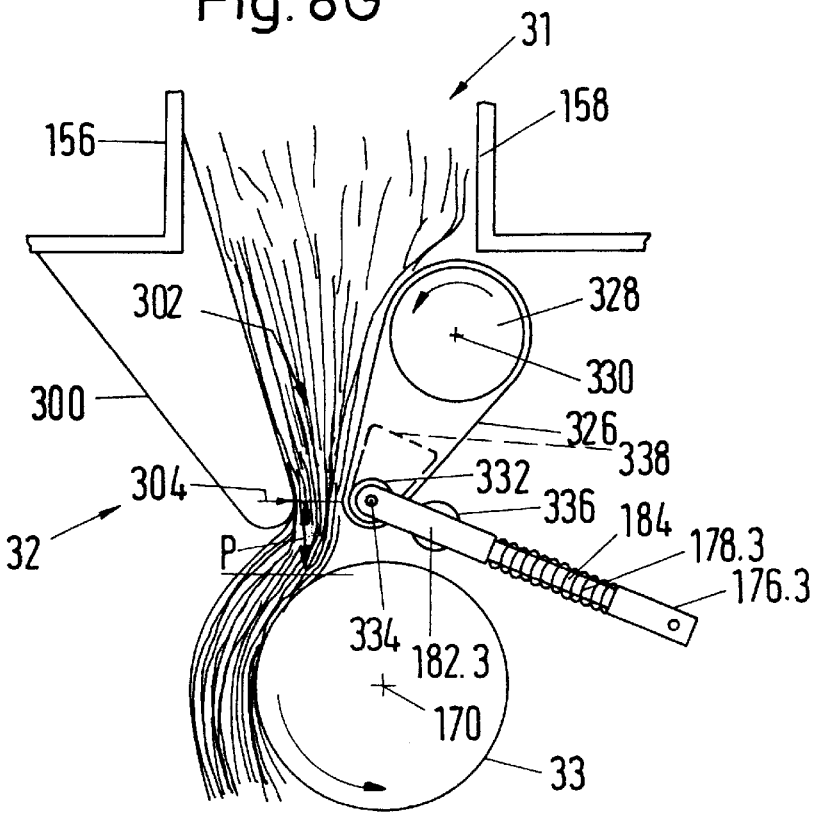

In the FIG. 8G a further development of the embodiment according to the FIG. 8C is shown in which the rotatable feed roll 320 is replaced by a revolving belt 326 according to the FIG. 8F. As the arrangement of the revolving belt 326 has been described extensively with reference to the FIG. 8F a further description of the same element can be dispensed with here. It should be noted, however, that the revolving belt 326 in this example definitely must be a driven belt. Also in this example the height 304 varies during operation, and the changes in this height are taken into account in the regulation of the surface speed of the revolving belt 326. This revolving speed of course is pre-set just as in all the other embodiments in which revolving belts are applied, by regulation of the rotational speed of the driven deflection roll coordinated thereto, in the case shown the deflecting roll 328.

Figure 8H:
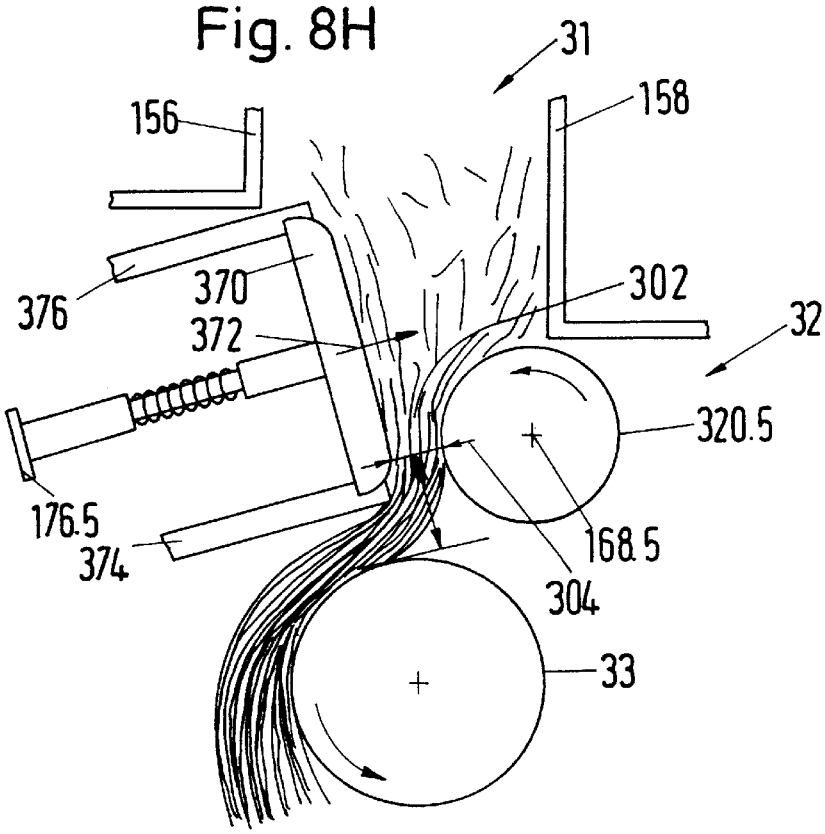
Figure 8I:
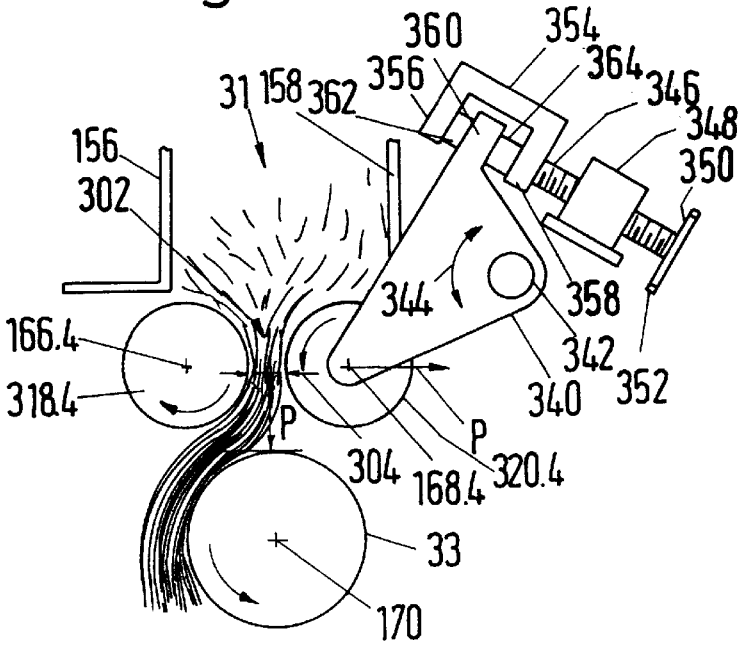

In the FIG. 8H an embodiment is shown in which the feed roll 320.5 is driven in the direction of the arrow rotatably about a fixedly arranged rotational axis 168.5. The feed roll 318 in this case is replaced by a spring -loaded feed plate 370, i.e. the plate is pre-tensioned in the direction of the arrow 372 against the flock mass using a pre-tensioning device 176.5. Guides 374 and 376 arranged below and above, and to both sides of, the plate 370 to ensure that the plate can move only in the direction of the arrow 372. Also here the measuring device which transmits a signal reflecting a change in the distance 304 of the minimum height of the feed gap 302 is incorporated into the pre-tensioning device 176.5. Instead of realising the spring loaded plate in the illustrated form, the plate itself cold be designed as a flat spring, in which case a separate measuring feeler would be required in order to check the changes occurring in the distance 304 during operation.

Figure 8J:
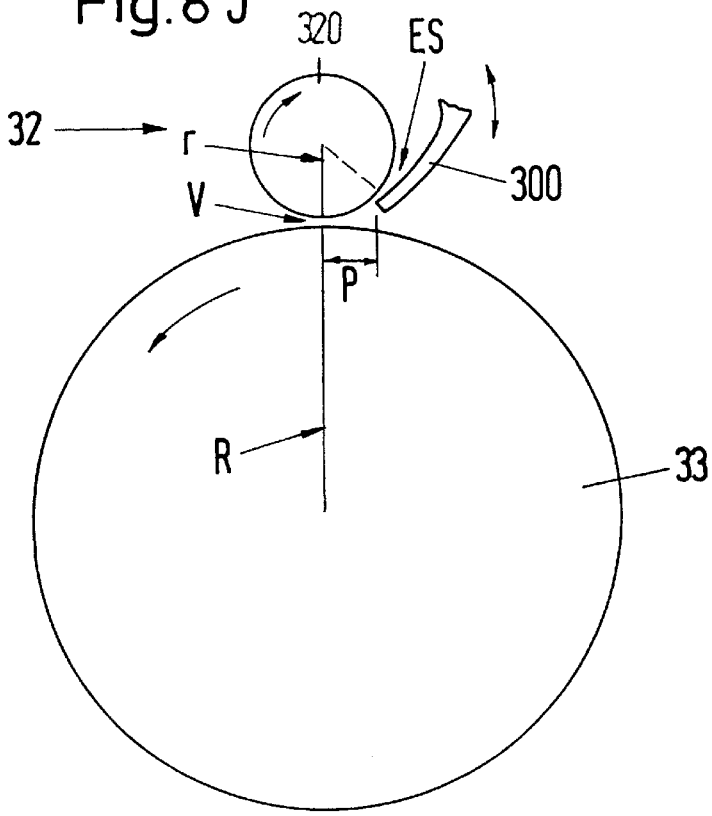

In the FIG. 8J a further development of the embodiment according to the FIG. 8A is shown in which both feed rolls 318.4 are to be arranged at fixed mutual distance set for a certain production rate m and are to rotate about fixedly arranged rotational axles 166.4 and 168.4 in rotational directions indicated by the arrows. The opening roll 33 in this arrangement rotates about the rotational axle 170 which also is arranged fixedly.

The rotational axle 168.4 of the feed roll 320.4 is supported at both its ends by plates 340 of substantially triangular shape as seen from the front side (one of which only being visible in the FIG. 8J) in which arrangement the two plates are interconnected by connecting rods (not shown). The plates 340 again are arranged pivotable about a fixed rotational axle as indicated by the double arrow 344. During operation a fixed position of the triangular plates 340 and thus also of the rotational axle 168.4 of the feed roll 320.4 is chosen, however. Positioning is effected by means of a threaded spindle 346 which extends through a solid body 348 threaded inside. A hand wheel 350 which also can be replaced by a motor drive permits rotation of the threaded spindle 346 in such a manner that the position of the triangular plates 340 can be determined. As a corresponding spindle arrangement is provided also for the second triangular plate, which is not shown, the two spindle dries are to be mutually coupled which can be effected e.g. via the revolving belt 352.

At the end of each of the threaded spindles 346 a yoke 354 is arranged, the legs 356 and 358 of which are arranged adjacent to one side each of an extension lobe 360 of the corresponding triangular plate 340. Between each leg 356 and 358, pressure force sensors 362 and 364 are provided which are connected to a computer via circuits (not shown). During operation the two feed rolls transport the fibre material through the feed gap 302 and via the point of minimum height 304 a force P acting onto the feed roll 320.4 tending to pivot the triangular plates 340 about the rotational axle 342. No actual pivoting motion can occur as it is suppressed by the spindle and yoke arrangement. The pressure force gages 362 and 364 permit determination by means of the computer of the value of the force exerted, taking the geometric conditions into account.

The variations of this force correspond to the variations in density of the flock stream at the point 304 which are processed in the computer in order to regulate the rotational speed of the feed roll 320.4 and, if required, of the feed roll 318.4 in case this roll is driven also, or alternatively, in such a manner that the desired mass flow $m_{soll}$ is maintained constant.

If the production rate of the chute is to be changed, this change can be effected either by merely changing the rotational speed of the feed roll 320.4 and possibly of the feed roll 318.4 as well. If, however a wider range of adaptability is to be created, the minimum height 304 can be adapted or set using the spindle 346 in such a manner that the changes in rotational speed of the feed rolls can be kept within pre-determined limits independently of the production rates desired for each application.

Finally it is to be mentioned that the embodiment shown in the FIG. 8J in which the distance 304 is maintained constant and in which the value of the force which tends to push the feed elements apart is measured, can be applied accordingly to all the other embodiments proposed instead of the pre-tensioned devices described.

Even if in the FIGS. 8B through 8G the pre-tensioning devices 176, 176.3 and 176.4 are shown in a form as the one shown in the FIG. 8A, it is evident that in practical application pre-tensioning devices preferentially are realised using gas pressure loaded springs or hydraulic devices, in order to maintain the pre-tensioning force constant independently of any changes in the minimum height 304.

In such a manner, offsetting forces are generated which, also if conventional pressure springs are used, lead to a net force which results in a pre-tensioning force remaining unchanged, or slightly changed only, as the settings of the feed arrangement are adapted.

In all embodiments according to the FIGS. 8A through 8J plates are provided of course at the face sides of the feed devices, and of the opening roll respectively, limiting the mass of flock material, or the flock stream laterally at the sides of the feed gap.

In the FIG. 8K an arrangement according to EP-A-419415 is shown schematically with an opening roll 33 and a feed device 32 which comprises a feed roll 320 and a feed plate 300. The directions of rotation of the rolls (indicated with arrows) cause a concurrent flow, i.e. the fibre material is carried away from the feed plate 300 by the roll 33 and after being taken over by the roll 33 is not carried back between the feed plate 300 and the surface of the roll 300. The feed roll 320 is arranged relative to the roll 33 in such a manner that a condensing gap V is defined between the radius R of the roll 33 and the radius r of the roll 320 extending on the line connecting the two roll centres. The condensing gap V defines the "take-over point" where the fibre material is taken over by the roll 33.

The feed plate 300 is arranged relative to the feed roll 320 in such a manner that a narrowest passage ES is defined. The distance "p" between the narrowest passage ES and the condensing gap V according to EP-A-419415 is to be adapted to the staple length of the material in process. Preferentially this is effected by adjusting the position of the feed plate relative to the roll 320 as indicated with the double arrow in the FIG. 8K. The position of the feed plate 300 is adjusted preferentially by pivoting it about the rotational axis of the roll 320 in extending to the narrowest passage ES with respect to the radius r extending towards the point V.

FINE CLEANING

Figure 11:
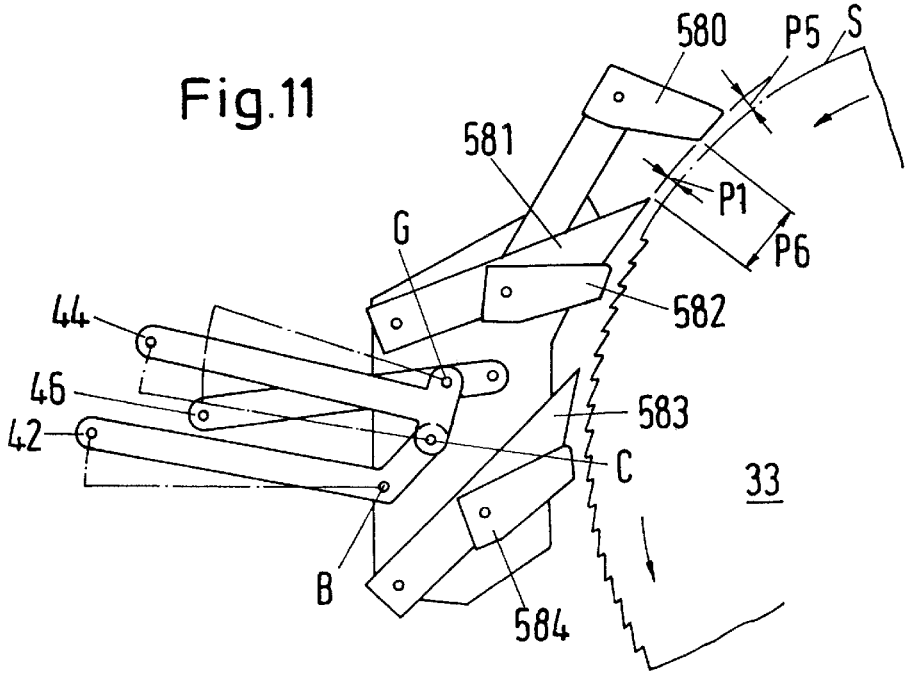
Figure 9:
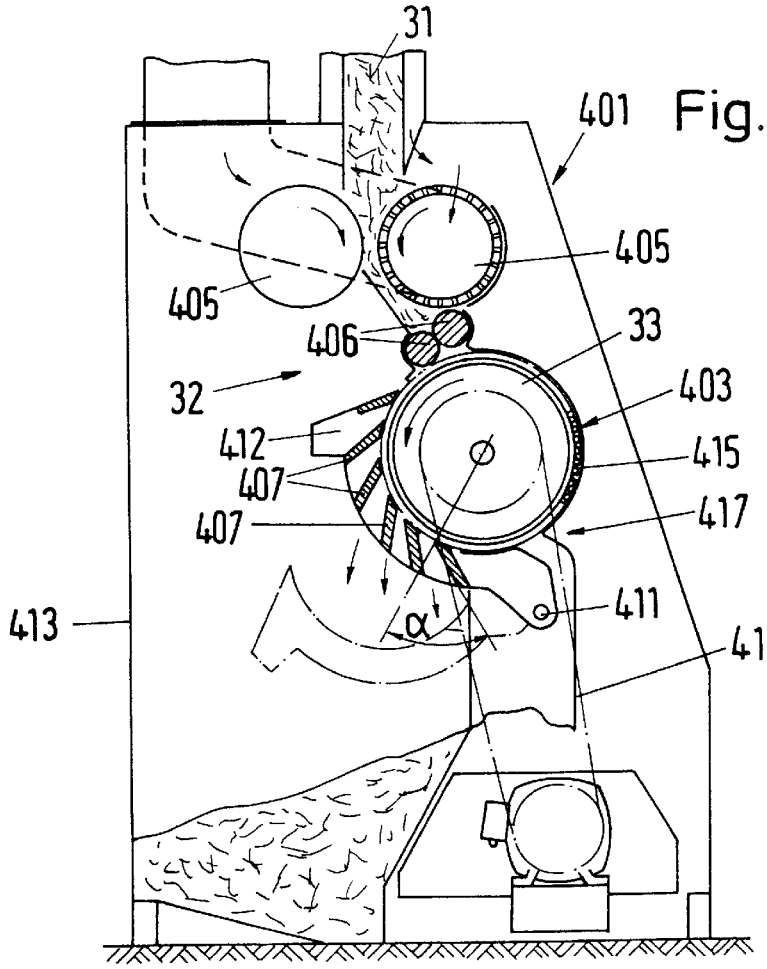
Figure 10:
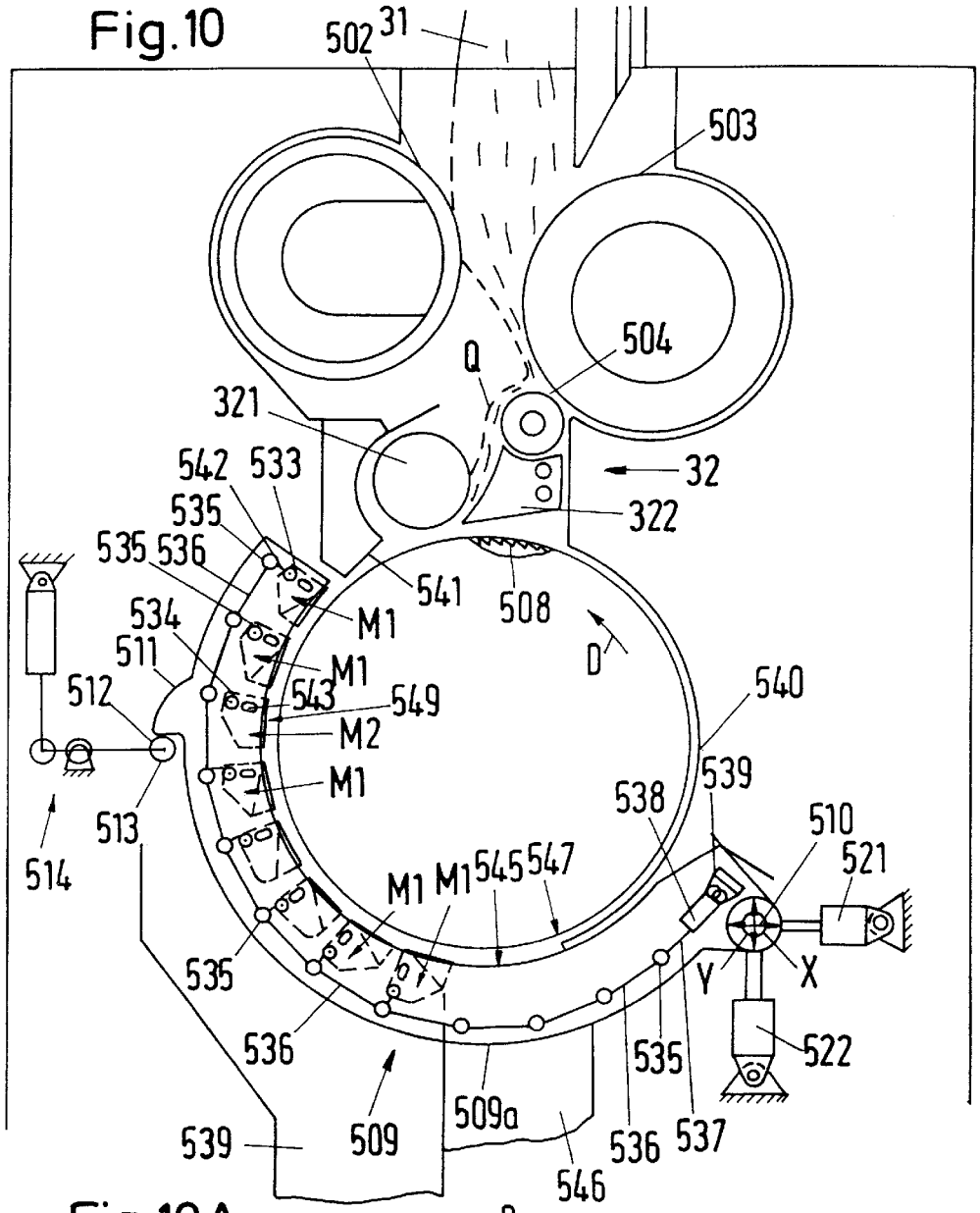

In the FIGS. 9, 10 and 11 each a possible realisation is shown of the cleaning function according to the FIG. 3 based on known devices already proposed for the fine cleaning stage. In all these Figures the reference sign 31 indicates the upper part of the chute (input chute), and the reference sign 32 indicates a feed device with a nip line, and the reference sign 33 indicates an opening roll (comp. FIG. 3).

The FIG. 9 is derived from the FIG. 1 of CH-C-464021. In the latter document a fine cleaning machine created in the 60*s* is described: A beater 33 provided with saw-tooth clothing 403 and supported in bearings in a housing 401 is supplied with coarsely opened fibre material from a chute 31 via a pair of condensing rolls 405 and a feed device 32 in the form of a pair of feed rolls 406. Subsequently, as seen in the direction of rotation of the beater 33, bars 407 are arranged equidistant and along about half the circumference of the beater and set closely to the circle swept by the beater (beater circle) under an angle of about 60°±10° with respect to the radius of the beater. The other bar surface extending also to the front edge encloses a small angle of about 0 to 2° with respect to the tangent of the beater. All the bars 407 forming the grid are arranged on a frame 412 which can be pivoted about a rotational axle 411 and which in its pivoted position, indicated with dash-dotted lines, makes room for the beater 33 to be moved out to the left hand side as shown in the FIG. 9 and to be replaced by another beater of a desired type, e.g. a beater provided with new or different clothing. On each grid bar 407 a guide plate is mounted providing a guide surface extending in tangential direction into close vicinity of the beater circle. This guide surface covers about half the distance between bars 407 to the next front edge. The position of each plate can be adjusted along its bar 407. An increase in the distance of the plate from the beater circle results in more intense lifting of the fibre material off the clothing of the beater under the influence of centrifugal forces and thus results in more intense impacting on the next front edge of the following bar 407. The impact imparted by this bar edge thus is directly influenced by the positioning of the guide plate and consequently also the degree of elimination of impurities is influenced without any changes being applied to the optimum position of the bars with respect to the beater circle once it has been established.

For application as an element of the present invention, the arrangement described in CH-C-464201 must be changed in such a manner that the beater at its side diametrically opposite the grid is provided with a cover 415 which joins the wall 416 of the lower chute part, an impacting edge being formed between the wall 416 and the cover 415. This edge 417 can be formed by the wall portions 415 and 416, or formed separately it can be mounted onto said wall portions.

The edge 417 serves for separating the fibre material from the roll 33 and for guiding it into the lower part of the chute.

In the FIG. 10 which is derived from EP-A-481302, a more modern embodiment according to the same principle is shown with a feed chute 31 delivering flock material into a converging gap formed between a blind drum 502 and a sieve drum 503 which sucks off air from the cotton material fed. This lap, from which the air has been bleeded, is guided via a take-off roll 504 into a further converging gap between a feed plate 322 and a feed roll 321, and using this feed roll is supplied to an opening roll 33.

This opening roll 33 takes over the fibres fed in by means of the teeth 508 provided on its surface (also called toothed clothing) in which process a layer of fibres guided by the teeth 508 is generated on its surface in the form of a fibre web. Owing to the relatively high circumferential speed of the opening roll and the resulting centrifugal force, this fibre web tends to be carried away from the teeth, and therefore the fibre layer before reaching the first grid bar module M1, depending on the distance between the feed roll 321 and a first grid bar module M1, is guided by means of a guide surface 541 arranged upstream (as seen in the direction D of rotation of the opening roll 33) of the first cleaning module M1 and thus is prevented from being thrown off. The fibre layer subsequently is guided along a series of cleaning elements, or grid bar modules designated M1, M2. The grid bar modules M1 are shown enlarged in the FIG. 10A. The module M1 consists of a grid bar 548 provided with flanges on its face side and with a separating edge 577 and a guide surface 576, whereas the module M2 consists of a clothing bar with a toothed clothing 549 (FIG. 10), provided with flanges 80 on its face side. The grid bars M1, M2 are taken up in a grid element 509 as explained in the following.

After passing the last module M1 the fibre layer placed on the teeth 508 of the opening roll 33 owing to the influence of the centrifugal force reaches an inlet 545 to the lower chute part. No guide elements being present at this inlet 545 radial outward movement of the fibres is not restricted. The tendency of the fibre material to move radially down (with respect to the roll 33) is assisted by an impact edge 547 similar to the impact edge 417 (FIG. 9). This edge can be formed by the wall portions 540 and 546 or, if formed separately, can be fixedly mounted thereon. The impurities eliminated drop into a collecting chamber 539.

The grid 509 comprises two grid frames 509*a* (one of which only is visible in the FIG. 10) between which the grid bar modules M1, M2 are mounted, in which arrangement the flanges of the grid bar modules rest against the inside surfaces of the grid frames. The grid frames 509*a* and thus the whole grid 509 are supported pivotably about a pivoting axis 510. The grid can be designed adjustable also in the X and Y directions, movable e.g. by setting motors 521 and 522. The grid frames 509*a* each are provided with a guide cam 511 presenting a guide surface 512 against which a guide 513 rests which is part of an adjusting mechanism 514.

Figure 10A:
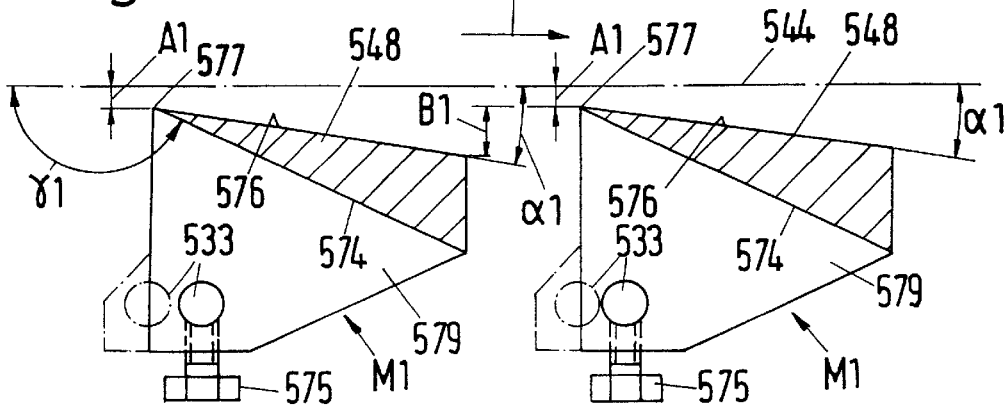

In the FIG. 10 a circle 533 marked with a dot represents a fixed connection of a pivoting lever 542 (designated only once in the FIG. 10) to a grid bar module M1, and at the same time represents a pivoting axle of the pivoting lever 542 and of the grid bar module, in which arrangement the grid bar module M1 is pivoted about this pivoting axle 533 as the this pivoting lever 542 is pivoted. Fixation of the position of the module M1 on the pivoting axle 533 is effected using a fixation screw 575 (FIG. 10A). The other end of each pivoting lever 542 is pivotably linked by means of a link member 535 to a force transmitting lever 536 each. The last link member 535, as seen in the direction of rotation of the opening roll 33, pivotably links the preceding force transmitting lever 536 to a plunger 537 which in turn is connected with a stationary support member 539. All force transmitting levers 536 being connected with each other via the link members 535, the force transmitting levers 536 all simultaneously participate in the movement of the plunger 537 in such a manner that all grid bar modules, containing a fixed connection to the corresponding pivoting lever 542, are pivoted.

In the FIG. 10 furthermore an empty circle designated 534 is shown, which indicates merely that the grid bar module M2 at this point is not connected to the pivoting axle 533 and thus also is not connected to the pivoting lever 542, and that the pivoting axles 533 and the pivoting levers 542 are required only for ensuring that the force transmission via all force transmission levers 536 functions properly. The fixedly mounted grid bar module M2 is fastened to the grid frame 509*a* by means of a screw 543. The screw 543 in this arrangement is guided in a guide slot provided in the grid frame 509*a* extending in radial direction with respect to the rotational axis of the opening roll 33 in such a manner that the position of these grid bar modules can be changed within this guide slot.

In the FIG. 10A two grid bar modules 579 are shown in an enlarged illustration, with a set angle $\gamma 1$ and a free angle $\alpha 1$. The set angle $\gamma 1$ is enclosed between a guide surface 574 and the beater circle 544 represented in the FIG. 10A as a straight line, whereas the free angle $\alpha 1$ is enclosed between the beater circle 544 and the guide surface 576 shown simplified as a straight line in the FIG. 10A. The guide surface 574 serves as a guide for the trash loosened from the fibre web. From the FIG. 10A it furthermore can be seen that the pivoting axle 533 is located, as seen in the Figure, in the left hand corner of the grid bar module, i.e. on the side of the grid bar module containing the knife edge 575. Owing to this arrangement the free angle α1 and the distance 131 are changed as the grid bar module is pivoted about the rotational axis of the pivoting axle 533, whereas the distance A1 remains virtually unchanged in such a manner that the distance A1 as set by adjusting the position of the grid 509 is influenced negligibly merely by the pivoting movement mentioned.

In the FIG. 11 an embodiment is shown which is derived from the one shown in the FIG. 4.1 of EP-A-419415 with two separating blades and three guide elements in the place of grid bar modules. On an outermost circumference of an opening roll 33 provided with a toothed surface, on the so called beater circle, the fibre web to be cleaned is moved through the cleaning stage in the direction of the arrows indicated in bold lines. The lap, seen in the direction of transport, which already before reaching this cleaning stage has been exposed to the action of the centrifugal force, and in which therefore trash particles have been concentrated, first passes under a guide element 580. The guide element protrudes into the transporting path and deflects the lap towards the inside, i.e. against the action of the centrifugal force and thus further reinforces the radial separation of the lap into impurities and fibres. After the guide element, seen in the direction of transport, a separating blade 581 follows. The lap passes under this separating blade and thereby is split into a fibre portion and a trash portion. Upon the separating blade, seen in the direction of transport, a second guide element 582 follows, then a second separating blade 583, followed by a third guide element 584.

In order to adjust the group of guide elements and separating blades for processing fibres of different origin or of blends, the following parameters can be set:

the distance $p_1$ between the separating blades 581 and 583 and the beater circle S, the distance $p_5$ between the guide elements 580, 582 and 584 and the beater circle S, the distance $p_6$ each between a guide element 580, or 582 respectively, and a separating blade 583, In the FIG. 11 also three levers 42, 44, and 46 are shown, using which the three distances mentioned can be set with the help of a motor drive. As the lever 584 is pivoted about an axis B as indicated in the schematic illustration with dash-dotted lines, the whole device moves away from the beater circle, i.e. $p_7$ and $p_5$ increase by the same amount. The positions of the lever 584 and of the separating blades 581 and 583 indicated represents the position closest to the beater circle.

As the lever 585 is pivoted about an axis C as indicated with dash-dotted lines in the Figure, the guide elements 580, 582 and 584 move in the direction of the lap transport without any change occurring in the radial position of these elements nor of the separating blades 581 and 583 relative to the beater circle S.

Expressed in other words, the guide elements 580, and 582 respectively, move up to the separating blades 581, and 583 respectively, in such a manner that the distance $p_6$ decreases. The position in which the lever 586, the guide elements 580, 582 and 584, and the separating blades 581 and 583 are shown in the Figure represents the situation in which the distance $p_6$ reaches its maximum.

Variant embodiments of the design example of the inventive apparatus shown in the FIG. 11 can differ in that:

the first guide element 580 is not provided, after the third guide element 584 a third separating blade is installed, i.e. that the separating device consists of three pairs of a guide element and a separating blade each, the complete cleaning stage comprises more than three pairs of a guide element and a separating blade each.

The opening roll 33 can be provided with a saw-tooth clothing, but it also could be designed as a needled roll. The stream of fibre material leaves the roll 33 in the same manner as described with reference to the embodiments according to the FIGS. 9 and 10 and drops into the lower chute part which substantially extends downward below the opening roll 33. Along the circumference of the opening roll 33, as seen in the direction of its rotation, between the chute part 31 and the lower chute part, elements are provided each performing one or the other of the following functions:

limit the fibre flow with respect to the opening roll, separate material (especially impurities) from the material flow, enhance the opening effect, whereby openings between these elements permit elimination of impurities.

The embodiments shown in the FIGS. 9 through 11 all function according to the same principle that the fibre stream moves along a curved path while material from the (radially) outer layers are separated and eliminated. The degree of opening can be adapted to the cleaning function in such a manner that the impurities can "migrate" radially towards the outside in such a manner that impurities rather than good fibres tend to be separated.

After the fibre stream has left these separating elements, it can be conveyed directly into the lower chute part. Further processing (e.g. using a sieve drum) and transporting are not required—such measures would result in nep formation (due to the enhanced degree of opening effected by the fine cleaning stage).

In a plant according to the present invention dedusting can be effected at any point where transporting air is eliminated from the system, e.g. at the intake of the coarse cleaner 4 as described with reference to the FIG. 4, but also in the upper chute part 31 (compare sieve drum 405, FIG. 9, or 503 respectively, FIG. 10). Provision of a dedusting stage after the opening roll 33 thus it not required, i.e. the fibre stream can be conveyed, as mentioned before, from the opening roll 33 directly to the lower chute part. This statement also applies to the application of the blowroom plant in connection with a spinning method (e.g. rotor spinning) particularly susceptible to dust, and to fine trash particles respectively. It also is known that a spinning preparation plant can be provided with a dedusting machine (compare U.S. Pat. No. 4,637,096)—an arrangement of that type can be applied also in combination with present invention described herein.

In the preferred embodiment, the cleaning device in the feed chute comprises one single opening roll 33. Cleaning devices are known, however, (e.g. DE 4039773) which contain a "roll series", i.e. a plurality of rolls provided with clothing each, in which arrangement each roll is provided with at least one element which eliminates impurities from the fibre stream. "Multiple roll cleaners" of such type also can be applied in a "cleaner chute" according to the present invention, even if they do not promise substantial advantages compared to a single roll arrangement according to the preferred solution.

Figure 12:
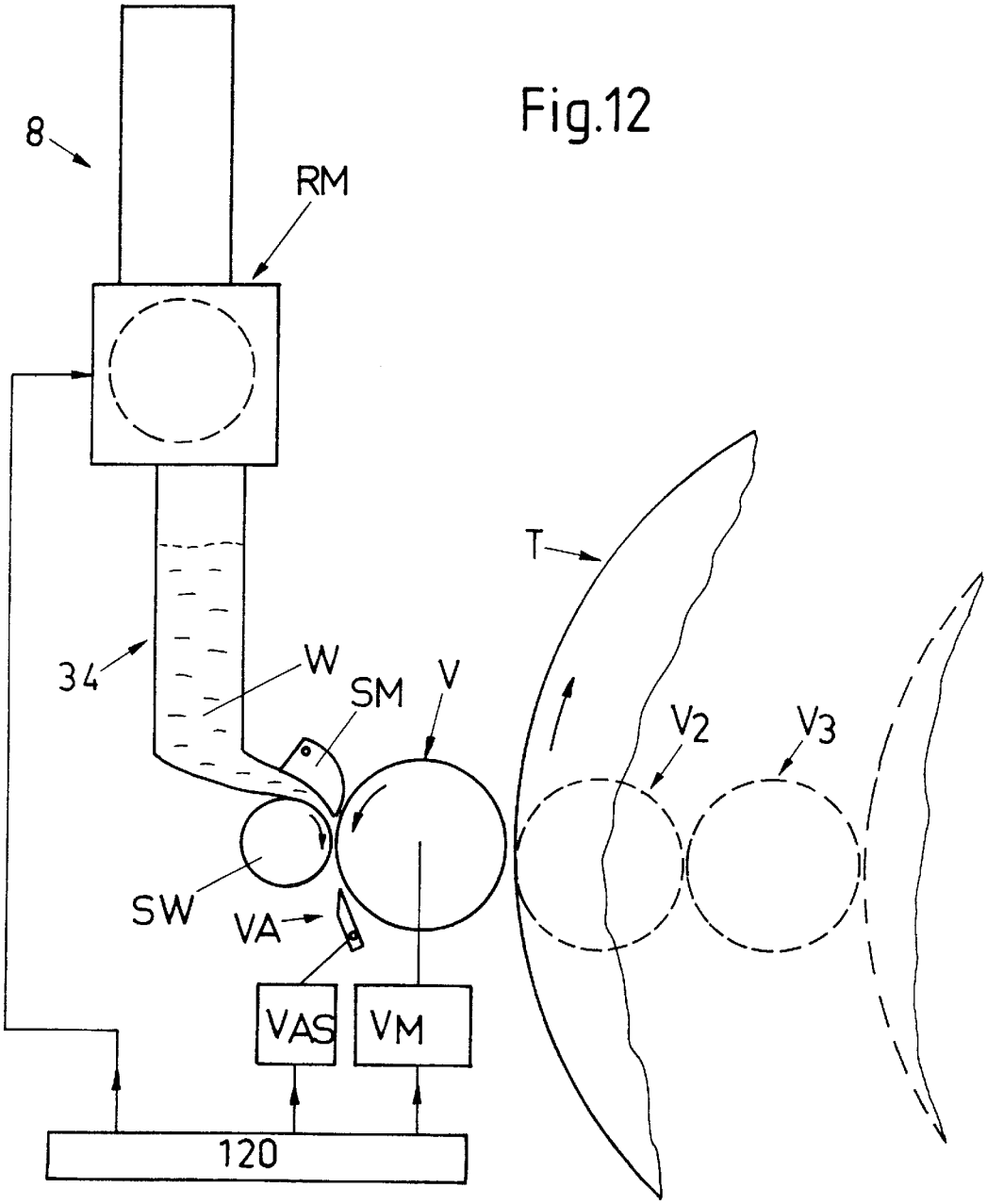

FIG. 12 shows schematically a feed chute 8 with a cleaning module RM according to this invention, e.g. according to one of the FIGS. 9, 10 and 11. The lower part 34 of the chute forms a fibre batt W from which fibres are fed to a licker-in V by means of a feed roll SW and a feed shoe SM. More than one licker-in can be provided, as indicated by the circles V2 and V3 in dotted lines. Reference VM indicates a drive motor provided for the licker-in V (and possibly also for the additional lickers-in V2, V3). Reference VA indicates a trash eliminating element in the licker-in module and the box VAS represents schematically an operating means for adjusting the element VA relative to the licker-in V.

The licker-in V together with its trash eliminating element VA forms an opening and cleaning device (a cleaning unit). Various units are known to be capable of fulfilling the requirements, see for example DE 4039773 or EP 618318. Both the cleaning module RM in chute 8 and the cleaning unit in the card infeed can now be connected with the card control 120 (see also FIG. 1), so that the can be adjusted together or independently of each other. The adjustment can be effected for example in co accordance with EP-B-452676 (or its equivalent U.S. Pat. No. 5,181,295).

The invention according to the present invention can also be combined with the invention according to the U.S. patent application claiming priority from Swiss patent applications 934/96 and 935/96, each dated Apr. 9, 1996 (inventors Jürg Faas and Christian Sauter). The content of that U.S. application is therefore incorporated in the present application by reference.

It should be understood by those skilled in the art that various modifications and variations can be made in the invention without departing from the scope and spirit of the invention. Ilt is intended that the present invention cover such modifications and variations as come within the scope of the claims and their equivalents.

What is claimed is:

1. A system for processing textile fibers from bales, comprising:

a bale plucker;

at least one card machine;

a flock transporting system disposed between said bale plucker and said card machine;

a feed chute configured with said card machine, said feed chute further comprising a first part for receiving flocks from said flock transporting system, and a second part for delivering a fiber lap to said card machine;

a cleaning device operably disposed within said feed chute between said first part and said second part, said cleaning device comprising a nip feed arrangement configured as a fine cleaner, said fine cleaner including an opening roll and trash elimination elements disposed around at least a portion of the circumference of said opening roll; and wherein said fine cleaner with said nip feed arrangement in said feed chute is the only fine cleaner within said system between said bale plucker and said cleaning device.

2. The system as in claim 1, wherein said card machine comprises a production rate of at least 70 kg/h.

3. The system as in claim 1, further comprising a coarse cleaning stage without a nip feed arrangement operably upstream of said feed chute.

4. The system as in claim 1, wherein no other cleaning device is disposed upstream of said feed chute.

5. A method for transporting fiber material from bales to a card machine, comprising removing fiber flocks from the bales with a bale plucker and transporting the fiber flocks with a flock feed system to a feed chute of the card machine without cleaning the flocks in a fine cleaner utilizing a nip feed arrangement, receiving the flocks from the flock feed system in a first part of the feed chute, moving the flocks through the first part of the feed chute and through a cleaning device disposed in the feed chute utilizing a nip feed arrangement configured as a fine cleaner, removing trash cleaned from the flocks by the fine cleaner with trash elimination elements within the feed chute, receiving the fiber material from the cleaning device in a second part of the feed chute and forming the fiber material into a lap; and transporting the lap to the card machine.

* * * * *